United States Patent [19]

Smith

[11] 4,447,205

[45] May 8, 1984

[54] INFRA-RED EQUIPMENT AND USE

[76] Inventor: Thomas M. Smith, 114 Villinger Ave., Cinnaminson, N.J. 08077

[21] Appl. No.: 238,418

[22] Filed: Feb. 26, 1981

Related U.S. Application Data

[63] Continuation-in-part of Ser. No. 186,491, Sep. 12, 1980, Pat. No. 4,378,207, and a continuation-in-part of Ser. No. 178,121, Aug. 14, 1980, Pat. No. 4,373,904, and a continuation-in-part of Ser. No. 94,901, Nov. 16, 1979, Pat. No. 4,272,238, and a continuation-in-part of Ser. No. 20,079, Mar. 13, 1979, Pat. No. 4,290,746, and a continuation-in-part of Ser. No. 952,332, Oct. 18, 1978, Pat. No. 4,326,843, and a continuation-in-part of Ser. No. 775,838, Mar. 9, 1977, Pat. No. 4,272,237, said Ser. No. 186,491, said Ser. No. 178,121, said Ser. No. 94,901 and said Ser. No. 20,079, is a continuation-in-part of Ser. No. 863,251, Dec. 22, 1977, Pat. No. 4,224,018, said Ser. No. 20,079 and said Ser. No. 952,332, is a continuation-in-part of Ser. No. 906,229, May 15, 1978, Pat. No. 4,157,155, said Ser. No. 906,229, said Ser. No. 863,251 and said Ser. No. 775,838, is a continuation-in-part of Ser. No. 701,687, Jul. 1, 1976, abandoned, said Ser. No. 775,838, is a continuation-in-part of Ser. No. 674,409, Apr. 7, 1976, Pat. No. 4,035,132.

[51] Int. Cl.[3] ..... F23D 13/12

[52] U.S. Cl. ..... 431/328

[58] Field of Search ..... 431/328

[56] References Cited

U.S. PATENT DOCUMENTS

| | | | |
|---|---|---|---|
| 1,608,388 | 11/1926 | Gritte | 431/328 |
| 3,061,000 | 10/1962 | Moore | 431/328 |
| 3,322,179 | 5/1967 | Goodell | 431/328 |
| 4,035,132 | 7/1977 | Smith | 431/7 |
| 4,252,520 | 2/1981 | Bratko | 431/328 |

*Primary Examiner*—J. Camby

*Attorney, Agent, or Firm*—Connolly & Hutz

[57] ABSTRACT

Fibrous mat type burners with elongated mats can be packaged strapped together in pairs face-to-face and enclosed in telescoping carton halves that allow for packaging burners of different lengths. Matrix edges can be held by clamping members that are curved where they engage outer face so that they do not dig into that face, but dig into inner matrix face. Burners with hat-shaped mats for enveloping and brazing heat-exchange tubes to tube sheet can be used individually or in pairs to effect such brazing on tube-and-sheet assemblies secured on rotating table and indexed into position under burners. Ceramic mats can be mounted around burner so that they are heated by hot burnt gases and their heated faces generate supplemental radiation toward work being heated by burner.

5 Claims, 32 Drawing Figures

Gas/Air
373
202

Prime Mover
374
372
312
Gas
V
372
399
381
371
382
361
Air
306
362
303
305
355
351
350
307
Suction
390
392
320
330
329
Suction

INFRA-RED EQUIPMENT AND USE

This application is a continuation-in-part of applications Ser. Nos. 186,491 filed Sept. 12, 1980 (U.S. Pat. No. 4,378,207 granted Mar. 26, 1983), 178,121 filed Aug. 14, 1980 (U.S. Pat. No. 4,373,904 granted Feb. 15, 1983), 94,901 filed Nov. 16, 1979 (U.S. Pat. No. 4,272,238 granted June 9, 1981), 20,079 filed Mar. 13, 1979 (U.S. Pat. No. 4,290,746 granted Sept. 22, 1981), 952,332 filed Oct. 18, 1978 (U.S. Pat. No. 4,326,843 granted Apr. 27, 1982) and 775,838 filed Mar. 9, 1977 (U.S. Pat. No. 4,272,237 granted June 9, 1981). In turn, Ser. Nos. 186,491, 178,121, 94,901 and 20,079 are continuations-in-part of application Ser. No. 863,251 filed Dec. 22, 1977 (now U.S. Pat. No. 4,224,018 granted Sept. 23, 1980); while Ser. Nos. 20,079 and 952,332 are continuations-in-part of application Ser. No. 906,229 filed May 15, 1978 (now U.S. Pat. No. 4,157,155 granted June 5, 1979); and Ser. No. 906,229, 863,251 and 775,838 are continuations-in-part of application Ser. No. 701,687 filed July 1, 1976 (subsequently abandoned). In addition Ser. No. 775,838 is a continuation-in-part of application Ser. No. 674,409 filed Apr. 7, 1976 (now U.S. Pat. No. 4,035,132 granted July 12, 1977).

The present invention related to apparatus for generating infra-red radiation, and the manufacture and use of such apparatus.

Among the objects of the present invention is the provision of improved apparatus for generating and using infra-red radiation.

Additional objects of the present invention include the provision of novel packaging arrangements for such apparatus.

The foregoing as well as additional objects of the present invention will be clear from the following description of several of its exemplifications, reference being made to the accompanying drawings wherein.

Figure 2:
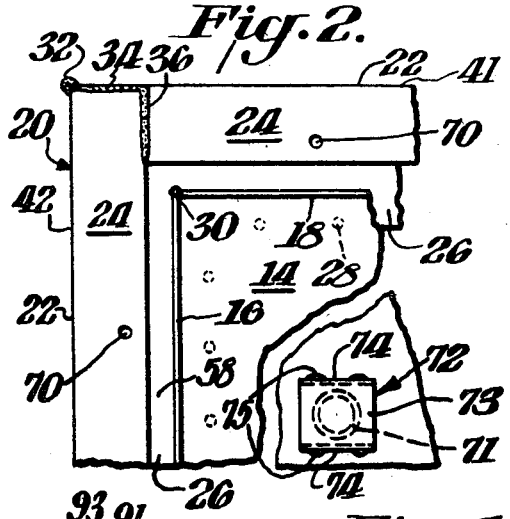
FIG. 2 is a plan view of a corner detail of the burner of FIG. 1, with the upper members removed.

The infra-red generators of the present invention have a felted fiber matrix pad with extended sufaces and at least about ½ inch thick, through which pad a gaseous combustion mixture is passed to emerge from one surface and to burn at that surface to heat that surface to incandescence and thus generate infra-red energy. Generators of this type are described in the above-noted parent applications and patents.

The matrix pad for a generator of the foregoing type can consist of at least two separate pieces of matrix butted together in edge-to-edge contact, the abutting edge faces being adhered to each other with a layer of silicone rubber not more than about 3 millimeters thick.

In such a cemented-together matrix pad it is preferred that the pad have its edges clamped in place in the generator, with each separate matrix piece extending to at least one of said edges.

Packaging of elongated burners having matrix pads so long that they are most readily made of adherently united matrix pieces, is greatly simplified by using telescopic packaging cartons. This is particularly desirable when burners of different lengths are being manufactured and are to be packaged for shipment.

According to this aspect of the present invention, two burners are clamped together in parallel with their front faces face-to-face, a first protective tubular carton closely fitted around the strapped-together burners, one end of the tubular carton being open, the other end being closed, another protective tubular carton telescoped over the first tubular carton and also having one end open the other end being closed, the tubular cartons facing in opposite directions and strapped together with their closed ends as the ends of the packaging combination.

Cushioning strip means can be sandwiched between the front faces of the strapped-together burners. Where the front faces of the burners have projecting fastener heads, such as of screws or the like, the cushioning strips used for the packaging are preferably perforated to receive the projecting heads, and thick enough to keep apart the faces and fastener heads of the strapped-together burners. Such cushioning strips are conveniently made of folded-over lengths of corrugated cardboard, but are not needed where the burners are clamped together so that they are held in spaced-apart relation.

A further aspect of the present invention involves an automatic apparatus using a radiant heater to seal heat-exchange tubes into tube sheets, as described in application Ser. No. 701,687.

According to the present invention such an apparatus contains a rotatable table having at least two indexing stations in its rotational path, and support means for holding an assembly of tubes and a tube sheet at each indexing station with the tubes positioned vertically, a radiant heater mounted over one indexing station and connected for automatic lowering and raising to surround the uppermost portion of the tube-and-sheet assembly at that station when the heater is lowered and to clear the tube-and-sheet assembly when the heater is raised, and a suction head movable between (a) a position under and in suction engagement with the tube-and-sheet assembly at the heater station and (b) a position that clears the table.

In the foregoing apparatus it is helpful to have the heater gas-fired, and to have a suction intake connected to draw off some of the gaseous combustion products from around the lower periphery of the heater.

A particularly simple movable suction connection can also be used for the suction head that is brought into and out of position below the tube-and-sheet assembly on the table. Thus the suction head can be carried by a suction pipe connected through a loose pipe connection to a suction source, the head being oriented for movement between positions (a) and (b) by rotation of the pipe around its axis, so that the loose pipe connection swivels to permit such head movement and also permits a small leakage into the suction source. This simplifies the use of a single source of suction connected to both the lower portion of the heater and the suction head below the table.

Another desirable feature pursuant to the present invention, is the use of two side-by-side heaters at the heating station of the automatic apparatus, to seal two side-by-side tube-and-sheet assemblies at one time.

Figure 1:
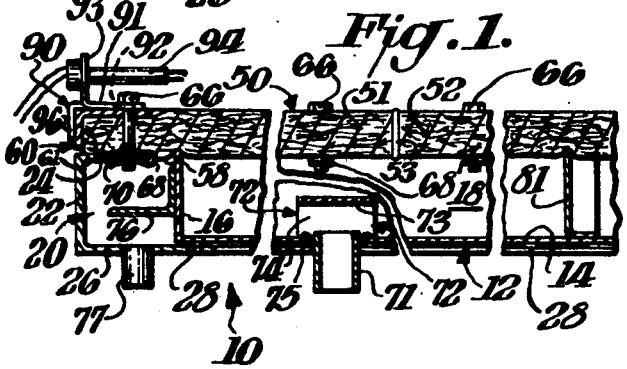
FIG. 1 is a sectional view of one form of infra-red generator or burner according to the present invention.

Turning now to the drawings, the burner 10 of FIG. 1 has an elongated metal plenum trough 12 whose floor is shown at 14 and side walls at 16, 18. The floor can be 14 by 120 inches in size, by way of example, with side walls 16 then 14 inches long, and side walls 18 120 inches long. The heights of the side walls need only be about $2\frac{1}{2}$ inches or even as little as $1\frac{3}{8}$ inches.

Around the periphery of the plenum trough 12 is secured a metal air-seal channel 20 having a web 22 and unequal flanges 24, 26. As illustrated flange 26 is longer than flange 24 and is spot welded by a series of spots, as at 28, to the bottom of plenum trough floor 14.

The corners of the plenum trough and of the air-seal channel are welded together as shown for illustrative purposes in FIG. 2. Weld 30 is a gas-tight joint between side walls 16 and 18. At the burner corner where air-seal webs 22 meet, a vertical weld 32 joins these webs, and additional welds 34, 36 join the flanges 24 together, and while these three welds can also be gas-tight, this is not essential.

The corner construction of the air-seal channel 20 as illustrated in FIG. 2 is made by notching out a square section of web 24 at the end of one rail 41 of the channel, and fitting the un-notched end of the adjacent rail 42 into place. The other flanges 26 of the channel rails can be similarly formed and assembled.

In many cases it is advantageous to use the corner construction of FIG. 2 because square notching can be performed more accurately than mitered notching as shown in U.S. Pat. No. 4,035,132. The product of FIG. 2 will then be simpler to weld together, even though a little extra welding is needed, and will present a better appearance. It is not necessary to weld or otherwise join together the flanges 24, 24 at a corner of the burner body. Indeed by providing a gap between these flanges at those locations the matrix-covering flange of the hold-down frame 20 is better permitted to undergo thermal expansion when the burner is in use, with less warpage of the frame. A similar technique for reducing warpage is shown in U.S. Pat. No. 3,824,064.

If desired the side walls 16, 18 of the plenum trough can have their upper edges provided with a short horizontally extending lip as shown in U.S. Pat. No. 4,035,132, in which event the lip can have a corner construction corresponding to that of the air-seal rail flanges.

Burner 10 has a porous matrix pad 50 positioned over the flanges 24 and upper edges of side walls 16, 18. The matrix pad is clamped in place by a rectangular hold-down frame 60 that extends around the periphery of the pad and is secured to flanges 24 by a series of attaching screws 66. These screws can be threadedly engaged in spring clips 68 fitted over holes 70 in the flanges 24, or in nuts held in these holes by nut-holding clips or the like.

Frame 60 is provided with screw-receiving holes aligned with holes 70, and the screws are drawn up tightly enough to compress the matrix edges as described in Ser. No. 775,838 and substantially reduce the porosity of those edges. The matrix pad is preferably of self-supporting although somewhat resilient construction about an inch or $1\frac{1}{8}$ inches thick with its edges compressed down to about 90% of its uncompressed thickness. The frame can have a notched corner construction similar to that of the air-seal rails shown in FIG. 2.

Because of the length of the burner, the matrix pad is made up of two pieces 51, 52, adherently united by a thin layer 53 of silicone rubber sealant. The joint is a simple butt joint and the adhesive layer thickness no greater than about 3 millimeters. The sealant is non-porous, but such a thin layer of sealant blocks off only a small and inconsequential portion of the face of the matrix pad. As a result the slight gap in the area over which the gaseous combustion mixture burns at the outer face of the pad, is of no consequence.

In use the incandescent condition of the surface fibers of the mat on both sides of the sealant layer 53 will cause the outermost portion of that layer to also get very hot and can partially decompose that portion. However the movement of the cool combustion mixture through the inner fibers of the matrix keeps them cool and also keeps the inner portions of the thin sealant layer cool. Thicker sealant layers are not kept so cool and show more thermal degradation. With the 3 millimeter thickness, the adhesive joint need only be about ½ inch deep to have a useful life of many months of operation. Best results are obtained with the adhesive extending the entire depth of the matrix.

The foregoing butt joint is much simpler to make than the tongue-and-groove joint used in the prior art with a sodium silicate type of adhesive deposited from aqueous solution. That prior art type of joint is actually more porous than the adjacent portions of the matrix, and tends to make the generation of infra-red energy much less uniform.

The butt joint can also be modified by connecting together two matrix lengths with the help of a metal foil both faces of which are coated with a thin layer of sealant such as silicone rubber. The overall thickness of the double-coated foil should also be not more than about 3 millimeters, even when the foil is a good heat conductor like aluminum. Some of the foil, with or without coating on it, can be permitted to project into the plenum, but there should be no projection beyond the outer face of the matrix.

As in the constructions of the parent applications, the burner 10 is provided with connection nipples to supply the plenum with combustion mixture and to supply air to the inferior of the air-seal channels. A nipple 71 for the plenum is shown as welded into trough floor 14 and a simple deflector baffle 72 welded above it to the inner face of that floor. That baffle is a short length of a channel that has only a body web 73 and two flanges 74, and is very simply tack welded as at locations 75, to the trough floor 14. If desired the baffle can be further simplified, as by making it a metal tab much like the bent tab baffle 76 shown for the air nipple 77, but having the bending angle an obtuse angle. One tab of such baffle can then be spot welded to the top of trough floor 14 alongside the nipple 71, to hold the remainder of the baffle at an angle over that nipple.

More than one combustion mixture supply nipple is used with burners as large as 120 inches. Two such nipples are enough, however, especially if symmetrically located about 60 inches apart along the burner's length, when the plenum is not partitioned into separate compartments. The plenum can be easily partitioned as by welding a sheet metal panel 81 in place in the trough, in which event there should be at least one combustion mixture supply nipple for each plenum compartment.

Panel 81 preferably does not extend into the air-seal channel, and it is not necessary to partition off the air seal, although this can be done as by a similar partition panel, if desired. The air-seal slot 58 by which air is discharged from the air-seal channel through the entire margin of the matrix pad, is preferably kept unobstructed. A gas-tight seal can be provided between partition panel 81 and the walls and floor of the plenum trough, but a simple spot welding is enough if the combustion mixture supply nipples are connected to gas and air sources arranged to supply only air to any plenum compartment that is not being fired while an adjacent compartment is being fired. The air pressure in the unfired compartment can then be made equal to or a little greater than the combustion mixture pressure in the fired compartment, to reduce the danger of combustion mixture leakage around the partition.

For some uses of the burners, they are arranged to generate infra-red energy over a variable length. Thus in the pre-drying of a wet fabric in a textile mill, the fabric processed can sometimes be as narrow as 30 inches or so, and sometimes as wide as 120 inches. The burners can then be partitioned as for example to provide a central plenum compartment 30 inches long, plenum compartments 20 inches long on either side of the central compartment, and plenum compartments 25 inches long at each end of the plenum. The appropriate compartments can then be fired to match the width of the fabric that is passed transversely in front of the burner for exposure to the infra-red energy.

It is preferred to have the hold-down frame 60 so dimensioned that its peripheral flange 61 lies in the same general plane as air plenum web 22 at all sides of the burner. This makes it unnecessary to have flanges 61 accurately located so as to fit around webs 22, and also uses less metal in frame 60.

The air nipple 77 can be mounted in the end wall 22 of the burner instead of in the burner back, if desired, in which case baffle 76 can be eliminated. Also said end placement can be duplicated on both ends of a burner, and the projecting air nipples and/or the pipe connections to them make convenient hanger mountings by which a burner can be held in pipe straps or U-bolts for example. Such pipe straps or U-bolts can slidably hold the nipples or pipe connections, so as to more readily allow for thermal expansion of the burner body as it heats up and cools down.

The matrix pad can have more than one joint 53, and such joints can be located within a few inches of each other, if desired. It is preferred however that each piece of matrix thus joined have an edge secured under the hold-down frame 60. Where the matrix pieces being joined have good edges at the joint, no special preparation is needed. Where those edges are damaged or out of true, they can be readily cut as by a table saw with a fine-toothed saw blade, to provide true edges.

The silicone sealant is sufficiently viscous that it can be spread over a matrix edge without penetrating into the matrix fibers more than about ½ millimeter. Any of the commercially available silicone sealants are suitable. Sealants made of lower temperature non-porous materials such as natural rubber or neoprene or epoxy resins, can be used in place of the silicone sealant but they degrade more severely when the matrix they unite is fired, and so are not preferred. The use of a rubbery sealant such as silicone rubbers is helpful in that the curing of the sealant does not convert it to a hard material that could cause damage to the matrix fibers when the matrix is flexed during handling.

Figure 3:
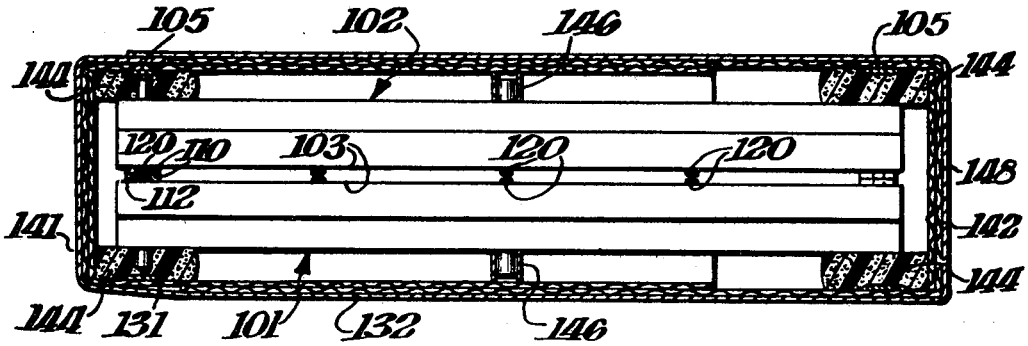
FIG. 3 is a view similar to that of FIG. 1 showing two infra-red generators packaged for shipment.

Burners of the foregoing type can be packaged for shipment in the manner illustrated in FIG. 3. Two burners 101 and 102 are secured together with their matrix faces 103 face-to-face. Ordinary steel or plastic strapping 105 can be wrapped around the ends of the assembled burners, tightened and clamped in place, as a convenient way to so secure the burners.

Figure 4:
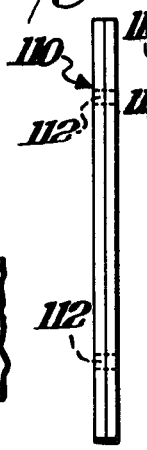
FIG. 4 is a side view of a packaging strip in the packaging arrangement of FIG. 3.
Figure 5:
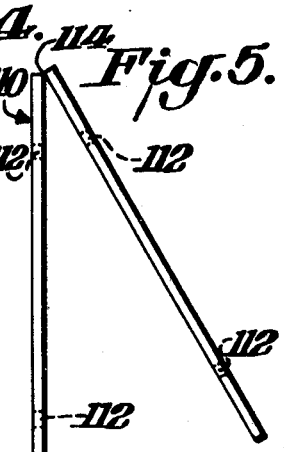
FIG. 5 is a side view of the packaging strip of FIG. 4, showing the strip partly unfolded.

Before assembling the burners in this face-to-face arrangement, it is particularly desirable to insert several cushioning strips 110 between them so as to cushion them against each other. A simple and highly effective cushioning strip construction is shown in FIG. 4 and FIG. 5. It is merely a narrow strip of 3/16 inch thick corrugated cardboard having holes 112 cut through, and scored at 114 so that it folds readily into the doubled-over position shown in FIG. 4. Holes 112 are spaced the same distance as the fastener heads 120 of a burner so that the cushioning strip is readily placed over a pair of such heads and thus holds itself in place until the second burner is placed over the strip.

Strips 110 in doubled-over condition are thick enough, ⅜-inch for example, to hold the burners apart so that they do not directly contact each other. Thus the hold-down frames 122 as well as the fastener heads 120 of the face-to-face burners are kept out of contact. One cushioning strip at each end of a burner is all the cushioning needed between short burners. Longer burners preferably have additional cushioning strips along their long edges.

The burners are desirably manufactured with their fastener heads 120 a standard distance apart, six inches for example, both along the length as well as the width of the burner, so that a single cushion strip configuration can be readily inserted anywhere. Such a cushion strip should have a length no greater than the narrow width of the burner face, and an eleven inch length works well with burners 14 inches wide. The matrix surface of such burners are also generally 11 inches wide and thus coextensive with the cushioning.

After the burners are strapped together the strapped assembly is inserted in a telescoping cushion-walled carton made of two tubular carton sections 131, 132. These sections are preferably of folded and pasted corrugated cardboard construction each having one end of its tubular length closed by an end wall 141, 142 respectively; the opposite ends of the tubular carton sections are open.

Packaging pads 144, of plastic foam for example, are best positioned under straps 105 and thus held so that they project beyond the longitudinal ends of each burner and the burner assembly does not tend to damage the end walls of the carton sections. Tubular protector sleeves or caps 146 can be placed over projecting nipples to protect them as well as keep them from damaging the adjacent carton walls. Pads 144 project beyond the backs of the burners a distance greater than the nipples, preferably as far as sleeves 146, and are readily penetrated by any air-seal nipples that they cover. These pads are thick enough to extend beyond the outer ends of such nipples.

The cartoned assembly can now be strapped together, as shown by strapping 148, and will withstand very rough handling.

The telescoping character of the carton sections permits the same pair of carton sections to be used to package burners of different lengths so long as their widths and depths are about the same. This is important because the burners are generally of about the same widths and depths but are required to have specific lengths which can vary widely from one installation to another. The burners are generally used in pairs, both burners of a pair being identical in length as well as in width.

Figure 3A:
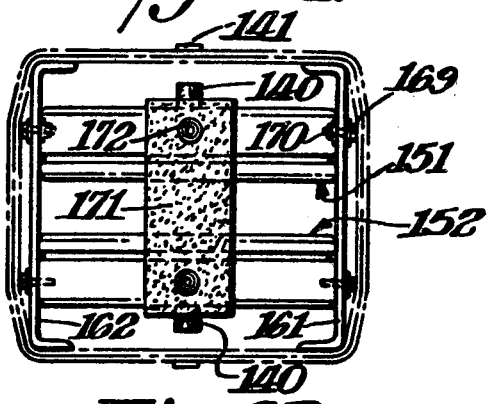
FIG. 3A is a transverse sectional view of a modified burner package assembly typifying the present invention.
Figure 3B:
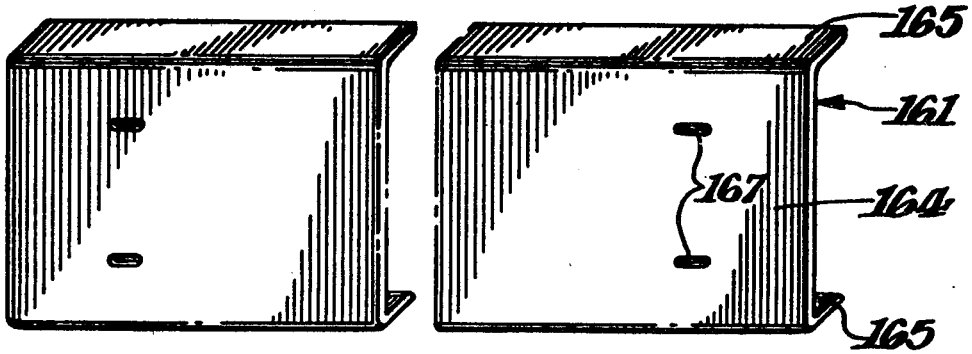
FIG. 3B is an isometric view of a clamping member in the assembly of FIG. 3A.

A more preferred packaging technique is illustrated in FIGS. 3A and 3B. Here burners 151, 152 are clamped in spaced-apart condition by means of clamping channels 161, 162, one of which is shown in greater detail in 3B. These channels have a central web 164 and flanges 165, 165. The webs 164 are wide enough, generally about 10 to 12 inches, to hold the burners apart by at least ¼ inch and hold their flanges 165 in a location beyond the furthest reach of the burner back, and of any projection therefrom, such as combustion mixture nipples 140.

Webs 164 are also punched to provide clamping slots 167 through which screws 169 are inserted and screwed into the body wall of each burner. To help receive these screws the body wall can be fitted with unthreaded or threaded openings, as by punched-out holes into which are set riv-nut type threaded sockets 170. Such sockets can be open at both ends, in which event the screws 169 can be used to close off the sockets when the burners are unclamped and placed in service. Alternatively the sockets can have their inner ends closed so that little or no air-seal gas will leak past them through the holes in which they are fitted.

The flanges 165 need only be wide enough to give the channels the desired rigidity and provide a surface against which the inner cartons 131, 132 are supported. A flange width of about 2 inches in adequate, but greater widths can be used with burners that are wider than the usual 12 to 14 inches. Cold-rolled plain carbon steel sheets about 60 mils thick are very inexpensively punched and shaped into the desired channels and work very well.

The FIG. 3A assembly does not require the strapping of the burners together before cartoning, so that the only strapping can be that applied around the cartoned assembly as shown at 141. Before cartoning however a cushion block 171 can be placed over the air-seal nipples 172 if those nipples project longitudinally from the burner ends. The cushion block can be a fairly stiff plastic foam such as polystyrene foam, and can have openings torn or punched out to receive nipples 172 and thus reduce the possibility of having those nipples tear out portions of the foam that might lodge themselves in the air seal plenum.

The strapping 141 can extend longitudinally or transversely of the burner lengths. Also screws 169 can if desired be of the flat-head type fitted into slots 167 that taper to match the tapered sides of the flat-heads of such screws, to thus reduce the projection of the screw heads against the cartons.

At least one pair of clamping channels 161, 162 should be used, but where the channels are much shorter in length than the burners, two pairs of such channels are preferred, one pair near each end of the burner assembly.

The burners can be provided with any desired ignition means, such as a pilot flame or electric sparking. In FIG. 1 a spark ignition attachment is shown as a bracket 90 having a web 91 with a mounting hole or slot 92 for insertion under the head 66 of one of the fasteners. A flange 93 bent out from one portion of web 91 has a mounting hole or slot for holding a spark ignitor 94 so that its sparking end is located over the matrix portion through which the combustion mixture passes. Another flange 96 can be provided to engage the side of the hold-down frame 60 and thus more positively locate the ignitor. Other types of ignitors are shown in parent application Ser. No. 952,332.

The ignitors can be readily installed in the field, and are accordingly not needed to be packaged in the packaging arrangement of FIG. 3. However that packaging provides empty spaces between the cartoning and the backs of the burners, and a separate envelope containing ignitors or ignitor parts can be fitted in those spaces.

The burners of the present invention can have a flat matrix face, as in FIGS. 1 and 3, or a concave or convex matrix face, as described in the parent applications. The concave type matrix face radiates energy that can be highly concentrated in a limited area, and is particularly suitable for heating such areas to very high temperature, or for very rapidly heating up such areas. An example of such rapid heating up is described in Ser. No. 701,687.

Figure 6:
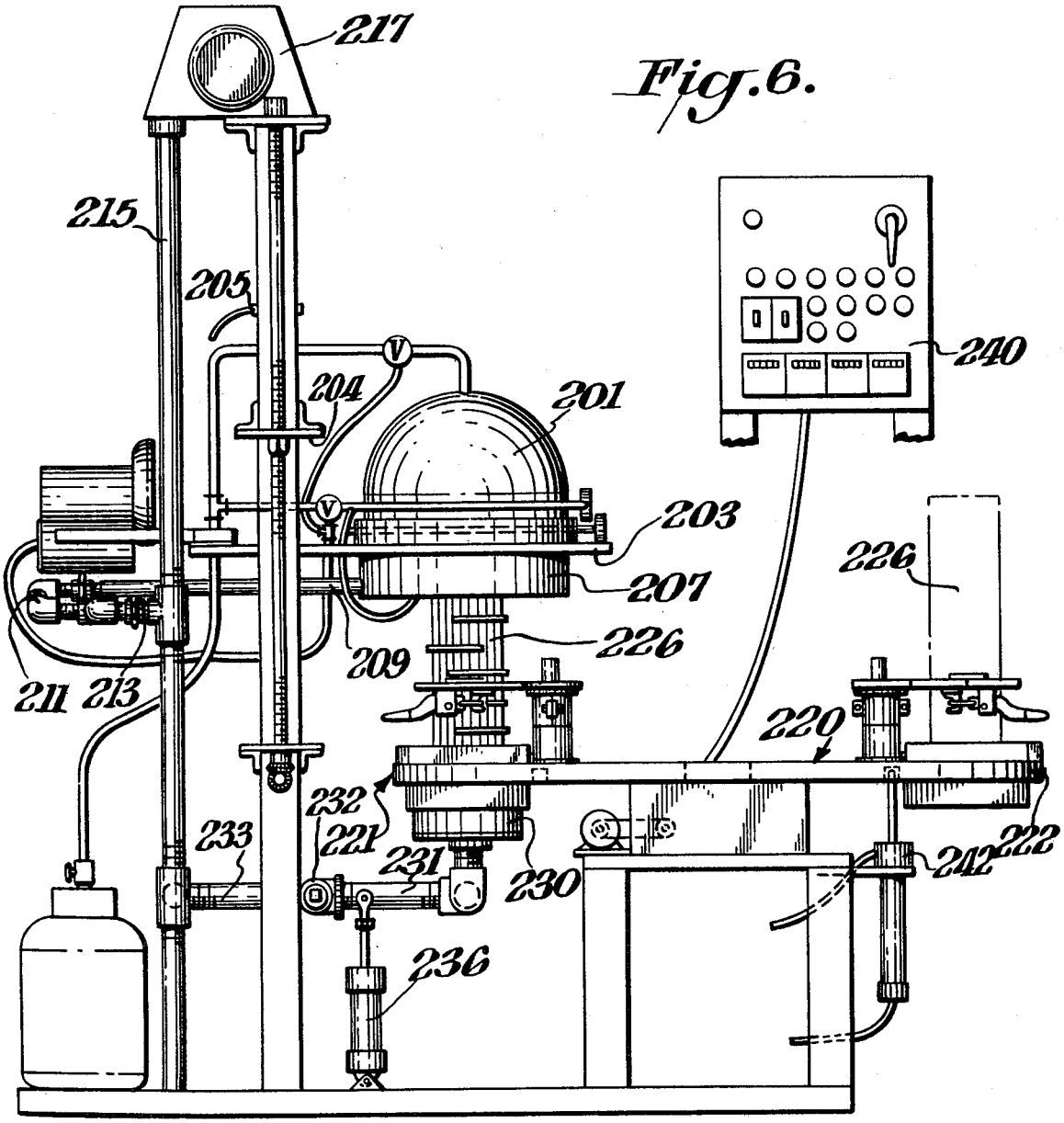
FIG. 6 is a side view of a different form of infra-red generating apparatus according to the invention, showing it as part of a brazing machine.

FIG. 6 shows a modification of the rapid heating device. The apparatus of FIG. 6 has a dome-shaped burner in a head 201 carried by a plate 203 that can be lifted and lowered with respect to an adjustable support 204 by an automatic arrangement, such as an electrically controlled hydraulic cylinder 205. Below the plate and surrounding the open bottom of the burner is a suction duct 207 that has its central wall perforated to draw off the gaseous combustion products generated by the burner. Duct 207 is connected through suitable piping 209, 211, 213 to a suction bus 215 which in turn is connected to the suction intake of a motor-driven centrifugal blower 217.

A rotating table 220 is positioned with one portion of it 221 below burner head 201 and defining a station at which a workpiece, in this case a tube-and-sheet heat exchange assembly 226, is held just under the burner head as described in Ser. No. 701,687.

The tubes are preferably staked or otherwise expanded at their ends so as to reduce the clearance between the outer surface of the tube and the edge of the hole in the tube sheet through which that end penetrates. The expansion is easily effected as by driving a suitably sized hard three-ribbed, bulbous tool about ½-inch into a tube end, while the tube is securely supported. This forms the tube wall radially outwardly, particularly at each rib, and causes the expanded tube portion to expand beyond the limit set by the size of the surrounding aperture in the tube sheet, locking the tube sheet in place by expansion both immediately above and immediately below the sheet. Withdrawal of the expansion tool can leave the tube end in the shape illustrated at 399 in FIG. 9.

A suitable expansion tool is conveniently made by grinding a bulbous nose on a length of drill rod, then grinding three generally tangential flats equally spaced around the major diameter of the bulb. Flats about 20 to 30 thousands of an inch deep easily allow about 8 mils expansion.

Expanding all the tube ends at each end of the tube bundle is desirable, but even expanding a few tubes helps lock the tube sheet in place against the expanded tube ends.

Another portion 222 of the table is out from under the burner head and provides another station where the workpiece can be fitted to the table in accurately located position, as by clamps, so that it will be properly located under the burner head when the table is rotated to bring the workpiece to station 221.

Below station 221, a suction head 230 is held on piping 231, 232, 233 that connects it to suction bus 215, and is arranged to be automatically lifted and lowered as by hydraulic cylinder 236, so that it can controllably apply suction to the lower ends of the tubes in the tube-and-sheet assembly. This application of suction draws some of the hot gaseous combustion products from the burner down through the upper ends of the tubes to effect more uniform and more rapid heat-up of the entire upper end of the assembly. A more complete discussion of the operation by which all the tube ends are sealed by brazing alloy to the upper tube sheet is contained in Ser. No. 701,687 the entire contents of which are hereby incorporated in the present application as though fully set forth herein.

The various suction pipes 209, 211, 213, 231, 232, 233 are of fairly large diameter, such as 3 inches, to adequately apply the suction. One very inexpensive type of piping to use for this purpose is standard cast iron pipe with lengths of it threadedly interconnected, using standard connection fittings such as elbows and tees. To permit the up and down movement of the burner head 201 as well as of the suction head 230, some of the threaded pipe joints can be left a little loose, even though such looseness permits leakage of air into the suction pipe. Thus a loose fit of pipes 209, 213 with the elbows that connect them to pipe 211 permits vertical suction head travel to lift and lower pipe 209 with respect to pipe 213, without significantly affecting the application of suction to duct 207. Similarly a loose connection of pipe 232 with the tee that connects it to pipe 231 permits the suction head movement. In each case the loosely threaded joints are those in which the threading axis is the axis around which rotation takes place.

Instead of merely having a simple threaded connection loosely engaged, the looseness can be provided by fitting a standard three-piece union connector to the pipe. Such a standard union has two separate pipe-engaged parts that can be coupled together by the third part to make a tapered or conical joint. For the purpose of the present invention the two pipe-engaging parts are each tightly threaded or otherwise tightly secured to the respective pipe lengths to be connected, but the third or coupling part of the union does not tightly couple the first two parts together. Instead the coupling part, which is generally threadedly engaged, is left incompletely threaded. It can be secured in the incompletely threaded condition, as by a set screw threaded through the coupling part and jammed against the pipe-engaging part to which it is incompletely threaded. This keeps the coupling thread from rotating so that rotation is provided solely between the tapered or conically mating surfaces of the pipe-engaging parts. These mating surfaces are smooth and not exposed to the outside, so that they are not likely to become jammed by dust or dirt, like exposed loose thread joints.

The apparatus of FIG. 6 is operated as by an automatic pre-settable electric controller 240, to rotate table 220 indexing it accurately into position while the burner and suction heads 201, 230 are held out of the way, then lowering the burner head, and igniting the burner, followed by raising the suction head, all timed to get the workpiece properly heated and sealed. The burner can then be extinguished, the burner head raised out of the way, the suction head lowered out of the way, and the table indexed around to carry the sealed workpiece to station 222 where it is removed and replaced by a fresh workpiece. While such removal and replacement are being effected, a workpiece previously mounted at that station but now at the sealing station is automatically subjected to the sealing sequence. Thus at each indexing of the table one sealing operation is completed.

The suction duct 209 is spaced from the top of the workpiece by at least about ½ inch, and its sucking effect on the gaseous combustion products does not interfere with the action of the suction head 230 which engages fairly tightly with the bottom ends of the tubes and draws hot combustion products down into those tubes.

The burner in head 201 is preferably equipped with an air-seal margin as in Ser. No. 775,838, and with two plenum compartments as in Ser. No. 701,687. Also the plate carrying the burner head can also carry a blower that provides the air for mixing with gas to make the combustion mixture. No flexing connection is accordingly needed for the blower air. The gas for combustion can be supplied through a flexible connection, but since the quantity of gas used can be only about one-tenth as much as the air used, the gas line can be of very small diameter, such as ½ inch or less. Flexible tubing for such thin lines are no problem.

The combustion mixture is supplied to the burner at a rate as high as 100,000 BTU per hour and can complete a sealing heat-up in thirty seconds or less, even when the workpiece being sealed is a collection of fifty tubes each having a 20 mil wall thickness and an internal diameter of ¼ inch. In practice the sealing operation can take somewhat over 30 seconds. The sealed tube-and-sheet assembly needs several minutes of cooling before it is handled, so that in many cases sealing times close to a minute are available between indexing steps of the table.

The indexing positions of the table can be accurately aligned as by a locating pin 242 hydraulically or pneumatically raised to engage a locating socket in the lower surface of the table. The table rotation is preferably cam operated with its rotational speed varied so as to be quite low as it nears an indexing position, and substantially higher during most of its travel between indexing positions. A very desirable time for effecting an indexing step is about ten seconds or somewhat less.

Figure 8:
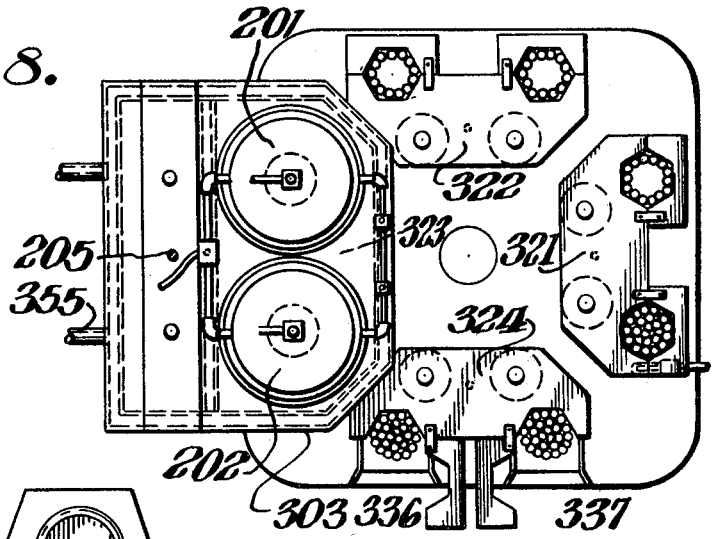
FIG. 8 is a plan view of the machine of FIG. 7.
Figure 7:
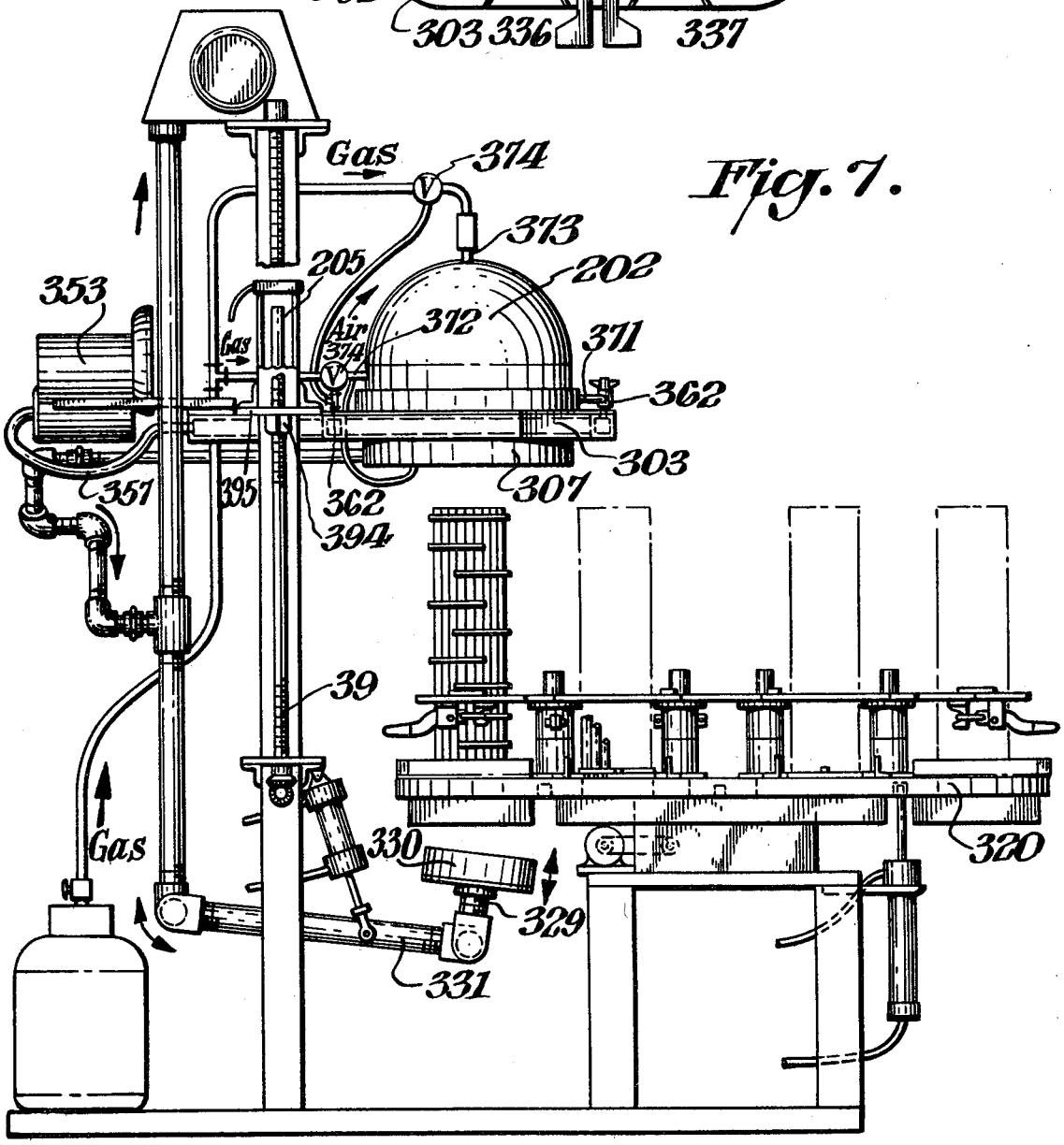
FIG. 7 is a similar view of a modified brazing machine pursuant to the present invention.
Figure 9:
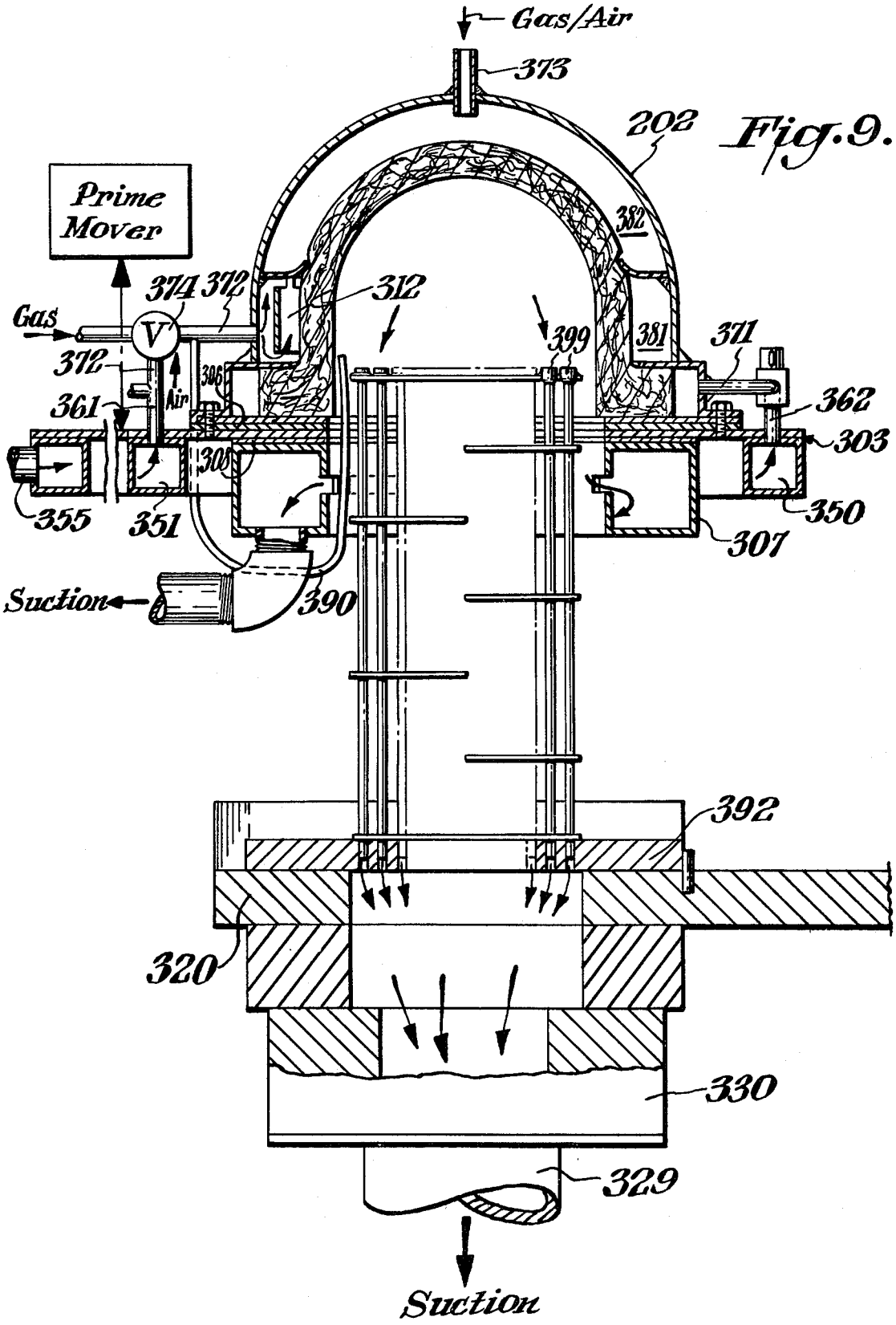
FIG. 9 is a sectional view of the machine of FIG. 8 showing details of its infra-red generating and utilizing construction.

The construction of FIGS. 7, 8 and 9 is a modified tube-to-sheet brazing machine having a table 320 with four indexing stations 321, 322, 323, 324 at each of which two tube bundles are arranged to be clamped in place side by side. At station 323 two burners 201, 202 are located and held in a frame 303 in side by side relationship corresponding to that of the tube bundles. The frame accordingly carries both burners down into heating position over the two tube bundles at station 323.

Frame 303 is illustrated as having a periphery made of square tubing 350 traversed by a cross tube 351 interconnected with the peripheral tubing. This frame tubing is arranged to conduct air from a blower 353 to both burners, one or more intake nipples 355 being connected by hose 357 to the air outlet of the blower, and discharge nipples 361, 363 being provided close to the burners for connection to the various burner inlets. One inlet 371 receives air only, for use as marginal air seal pursuant to the parent application. Two other burner inlets 372, 373 are connected to mixing valves 374 that can be separately controlled to independently deliver air or air-gas mixtures to two separate plenums 381, 382 of each burner.

A suction conduit 331 is branched to provide two separate suction heads 330, one for the lower end of each tube bundle at station 323. The use of a single suction head that spans across both tube bundles and has only one suction connection is not desirable inasmuch as such an arrangement tends to cause the suction application to be too non-uniform; a little high in locations close to the suction connection and a little low in locations remote from that connection. The preferred suction connection is a conduit 329 axially aligned with the tube bundle through which it sucks gas downwardly.

Strips of thermal insulation 306, 308 can be inserted between frame 303 and the burner bottom, as well as between the frame and the suction ring 307, to help keep the frame from excessive heating. A baffle 312 can also be secured to the partition between burner plenums, to help direct the combustion mixture flow in plenum 381.

The apparatus of FIGS. 8 and 9 with its greater number of table stations has its table rotate from one station to the next in less time than that of FIG. 7, and has twice as many tube bundles brazed at each station. The combined result is a sharp increase in output. To operate the two-burner apparatus at its highest efficiency both burners are adjusted to supply about the same heat output, so that the sealing time is not lengthened unnecessarily by a lower heat output from one burner. If desired the two burners can be timed so that one burns for a somewhat different time than the other, to help compensate for heat output differences or the like. Thus one tube bundle can be previously unheated, and its companion bundle can be hot from a brazing that has just been completed on its opposite end or elsewhere, and accordingly needs slightly less heat-up.

A pilot gas line 390 can be used to supply a small pilot flame that ignites the burner each time either plenum is supplied with combustion mixture. The burners can also be operated by merely turning them down, rather than completely off, between sealing steps, in which event the pilot can be eliminated and ignition provided only when the apparatus is placed in operation.

The table holding the tube bundles can be provided with replaceable and interchangeable inserts 392 that are specially shaped, drilled and positioned to receive the lower ends of different types of tube bundles. For bundles of different heights, the frame 303 is arranged to be set at different levels as by the rotatable long threaded shafts 393 threadedly engaged in nuts 394 welded to a cross bracket 395 against which frame 303 is held by its hydraulic operator or other prime mover.

The burners described above are desirably constructed with their metal portions made of sheet metal that can be as thin as 30 to 50 thousandths of an inch. The metal housing for the hat-shaped burners can be drawn or spun, preferably of aluminum, and the metal housings for the flat burners are conveniently of bent and welded-together stainless steel members. Where a flat burner is particularly long and has few pipe connections, it is conveniently stiffened as by welding an extra length of channelling or tubing to the back of the longitudinally-extending sections of the air-seal channel.

The hat-shaped matrixes for the burners of FIGS. 6 through 9 can be formed in one piece or they can be pieced together. Thus the brim of the hat can be cut out from a flat matrix sheet and joined to the crown-shaped matrix portion. The crown-shaped portion can be formed by interfelting the ceramic fibers from a suspension in air or water, in a porous mold made of wire screening shaped to provide the desired crown. The margin of the crown can then be butt-joined to the brim of any of the above-mentioned resinous sealants.

Although the layer of sealant used is extremely thin, it makes an effective block against movement of gas through it. The marginal air-seal air flow for the hat-shaped burner can accordingly be through the entire height of the brim of the hat up to the sealant layer, so that combustion mixture does not have to flow through a narrow matrix portion below that layer.

Figure 10:
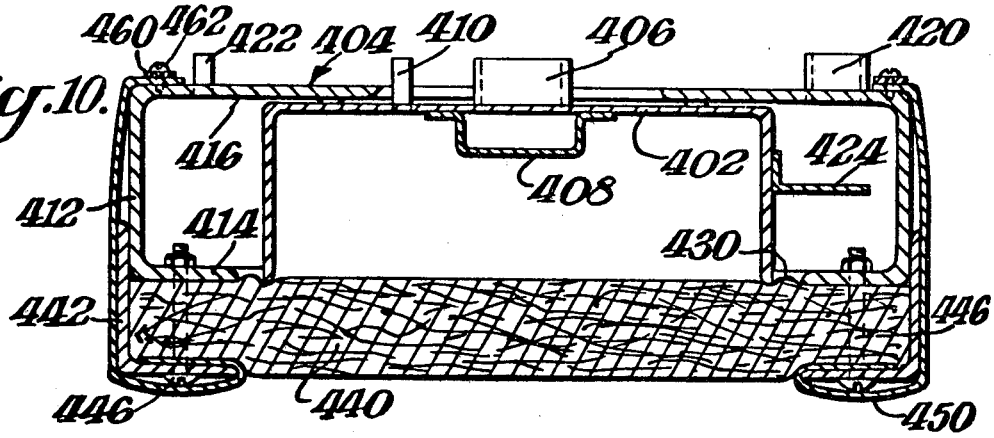
FIG. 10 is a sectional view of a modified burner representative of the present invention.
Figure 11:
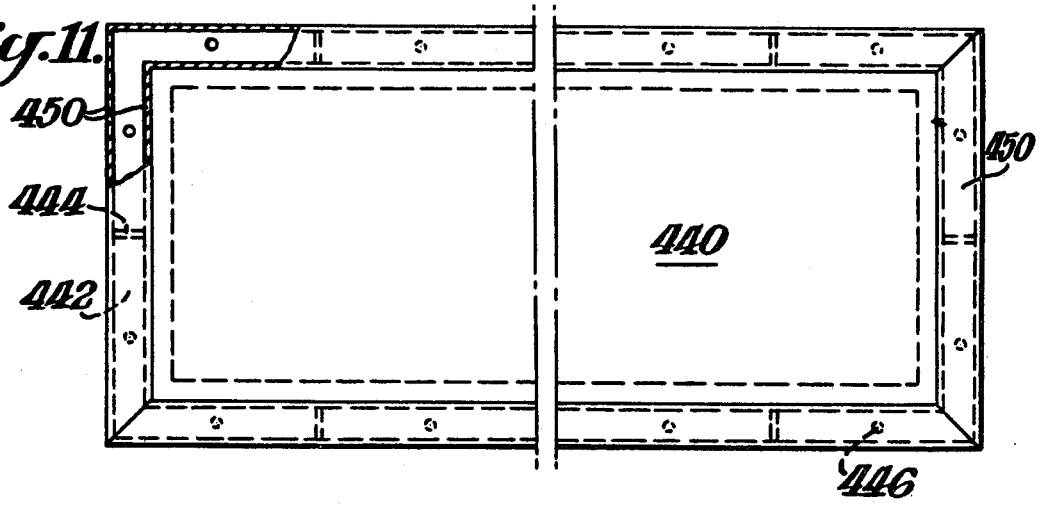
FIG. 11 is a plan view, with parts broken away, of the burner of FIG. 10, looking up at its face.

The construction of FIGS. 10 and 11 is one for flat heater panels easily manufactured from readily available sheet metal such as stainless steel 0.059 inches thick. Like the construction of FIG. 1, it has a panel support which is welded-together assembly of a rectangular plenum box 402 and a hollow-centered rectangular encircling plenum tube 404. Plenum box 402 is conveniently prepared by suitably notching out the corners of a rectangular sheet, then bending up the four wings thus formed, and welding the resulting corners gas tight. A hole can then be punched in the floor of the box to receive a PTM half close nipple 406 also welded on gas tight. A baffle 408 can also be spot welded over the hole to distribute the combustion mixture fed through it. If desired an extra tap 410 can also be provided at a second hole in the box floor, for a pressure gage or the like.

Tubular plenum 404 is easily made from sheet metal bent into the shape of a channel having a web 412, and unequal flanges 414, 416. The channel is cut into four lengths each of which is mitered and then welded together gas tight, although gas-tightness is not essential. The tubular plenum can then be affixed to the plenum box as by spot welding the flanges 416 to the floor of the box. A gas inlet 420 in the form of half a close nipple can be affixed to the floor or side of the tubular plenum, along with an extra tap 422 in the same manner as for the box plenum, and a baffle 424 can be fixed over a floor inlet 420 by spot welding to either the outside of the box plenum or the inside of the tubular plenum. A side inlet to the tubular plenum needs no baffle.

A slot 430, preferably ¼ inch wide, encircles the top of the box plenum. The refractory matrix 440 is clamped in place by a clamping frame 442 of angular section as illustrated in FIG. 10 and having slits 444 cut in the web overlying the face of the matrix panel as shown in FIG. 11. The slits can be about 8 inches apart and preferably at least 1/16 inch wide to take care of the most severe thermal conditions. The clamping frame is secured by screws 446 as in the construction of FIG. 1, although sheet metal screws can be used instead in either construction, in which event the nuts can be omitted and if desired locking washers fitted under the screw heads.

In severe thermal conditions, such as firing face down as illustrated, or when firing directly at opposing burners, it is desirable to insulate the clamping frame 442 from the radiated and convected heat by over-wrapping with a high temperature insulating material such as mineral fibers felted or needled in blanket form. FIG. 10 shows a fiber blanket 450, approximately ¼ to ½-inch thick, clamped and compressed between clamping frame 442 and refractory matrix 440, wrapped around the clamping frame 442 and web 412 and secured to flange 416 by means of clamp 460 and sheet metal or other screws 462. The fiber blanket 450 insulates the clamping frame from convected heat and its pure white color reflects some radiated energy from opposing burners making the system more efficient. In very high ambient operating conditions it may be desirable to completely wrap the non-radiant surfaces of the burner of FIG. 10 with the fiber blanket.

Figure 12:
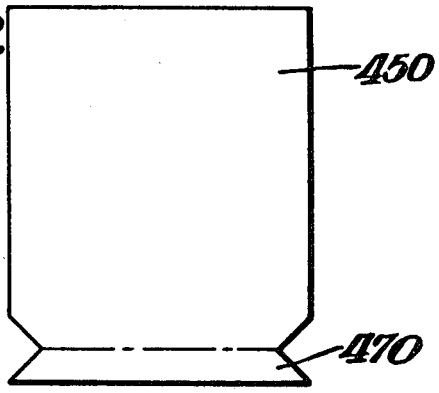
FIG. 12 is a plan view, unwrapped, of a thermal insulation blanket that is wrapped around the burner of FIGS. 10 and 11.

FIG. 12 shows the fiber blanket 450 as prepared for installation, having a tuck-in margin 470 which is inserted under the face of clamping frame 442.

In less severe applications it may be desirable just to cover the face of 442 and hold the blanket in place with the screws 446 and washers under their heads.

Figure 13:
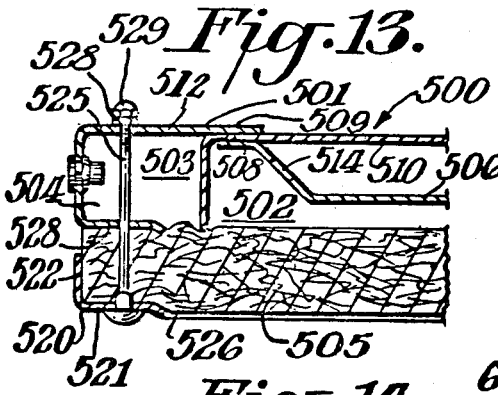
FIG. 13 is a fragmentary sectional view of a further modified burner in accordance with the present invention.
Figure 14:
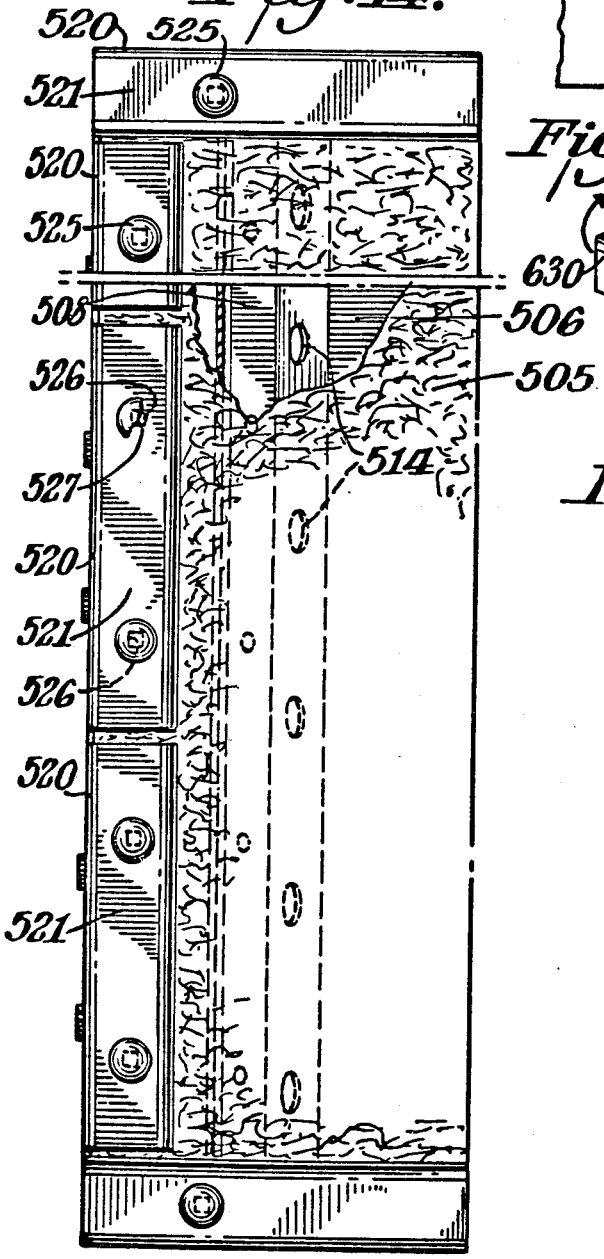
FIG. 14 is a plan view of the burner portion of FIG. 13.

The burner 500 of FIGS. 13 and 14 is a particularly preferred construction for burners that are very long—for example four feet long or longer. This construction is very much like those of FIGS. 1, 3 and 10, having a burner body 501 with a combustion mixture plenum 502, an air-seal plenum 503, and a matrix-supporting shelf 504 engaging a matrix 505. Within the combustion mixture plenum 502 a diffuser 506 covers the combustion mixture inlet and extends the length of the plenum. Diffuser 506 is preferably cold-rolled plain carbon steel sheeting about 0.050 inch thick bent into the shape of a trough with side flanges 508 spot-welded as at 509 to the floor 510 of plenum 502. The spot welds 509 are shown as made so that they also weld in place the flange 512 of the air-seal plenum channel, and a single spot weld welds flanges 508 and 512 to floor 510.

The diffuser has a series of apertures 514 in its side walls to permit free passage of combustion mixture to the matrix. Another desirable feature of the diffuser is that it can be kept relatively cool by the incoming combustion mixture, and when used with a burner body having an air-seal periphery will keep that body from excessive thermal expansion even without thermal blanketing as in FIG. 10. Such expansion can operate to pull the matrix apart, inasmuch as the matrix edges are tightly clamped to the body shelving and the incandescent face of the matrix is not very resistant to stretching. The full-length diffuser 506 also greatly stiffens the burner so that little or no external stiffening is needed even for burner bodies as much as 12 feet long. Alternatively the burner body can be made relatively thin, as from 0.050 inch thick sheet metal.

It is not desirable to reduce the matrix edge clamping so as to permit the matrix edge to slidably adjust themselves on the shelves 504. Quite the contrary it is helpful to lock the matrix edges in place, as by curling out the edge of the shelf 504, as shown in FIG. 13, so as to cause that edge to dig into the back of the matrix. Only about 1 to about 5 millimeters of the shelf width at its inboard edge is all that need be so curled, and only about 1 to about 2 millimeters of outward projection of the curled edge is adequate.

The burner of FIG. 13 is well adapted to operate face down, and to this end has its matrix clamped in place by a series of relatively short hold-down angles 520 spaced from each other by about 1/16 to about ¼ inch. The hold-down face flanges 521 of these angles will get relatively hot in use and the spacings permit those flanges to undergo thermal expansion without much warpage, so that the matrix remains securely held.

A particularly effective form of hold-down angle 520 has the inboard edge of its face flange 521 curled out about the same way as described for the shelf 504. This keeps that flange from digging into the face of the matrix where such digging can cause premature failure of the matrix. Angles 520 are shown as clamped by carriage bolts 525 the square shanks 526 of which are received in square holes 527 punched in flanges 521. The carriage bolts also extend through round holes 528 in shelves 504 and in back flange 512, and are drawn up tight by a plain nut 528 which can be backed by an acorn nut 529 that covers the relatively sharp bolt end with a rounded surface that keeps those ends from tearing anything they happen to contact.

Hold-down angles 520 are preferably about 6 to about 12 inches long, each equipped with two bolt-mountings. Also they appear to work better when made of relatively thick sheet metal, e.g. at least about 0.070 inch thick. The burner body generally need be no thicker than about 0.060 inch. Flanges 522 on these angles need only be about $\frac{5}{8}$ inch wide.

Figure 15:
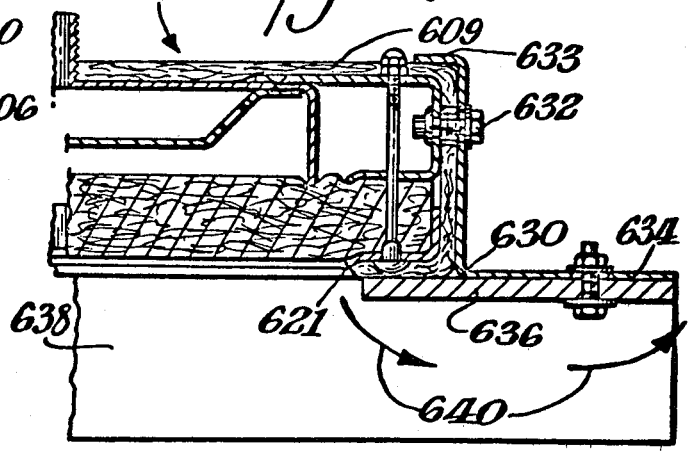
FIG. 15 is a view similar to that of FIG. 13 of a still further burner construction representative of the present invention.
Figure 16:
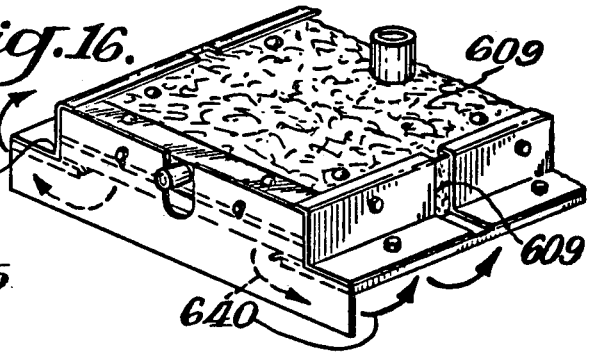
FIG. 16 is a perspective view of the burner portion of FIG. 15.

The burner 600 of FIGS. 15 and 16 is shown as the burner 500 provided with thermal insulation blanketing 609. The blanketing extends transversely across from the hold-down flanges 621 along one long side of the burner over the burner back and over to the opposing hold-down flanges. The ends of the blanketing are shown as held in position by a series of metal wings 630 fastened to the burner body as by bolts or screws 632 in a manner similar to the fastenings 169 of FIG. 3A.

Wings 630 are also shown as having outwardly extended arms 634 to which a sheet of additional thermal insulation 636, preferably molded into a self-sustaining block, can be mounted to face the work being irradiated by the incandescent face of the matrix. The block or blocks 636 can thus be similar to the matrix, but they do not have to withstand the same high temperatures. In use hot combustion gases generated at the incandescent matrix face flow out over the blocks 636 and heat the outer faces of the blocks hot enough to cause those faces to materially add to the irradiation from the matrix. A block width of at least about 1 inch is needed to this end, and blocks as much as 5 inches wide are particularly effective.

Wings 630 are shown in FIGS. 15 and 16 as provided with positioning flanges 633 that engage the back of the burner or the insulation covering that back. However these positioning flanges can be omitted.

The blanketing 609 in FIG. 16 is shown as extending the entire length of the burner, but not over the flanges 621 of the hold-down angles at the burner ends. Instead those ends are covered by deflector panels 638 of sheet metal, for example, that project down below the insulation blocks 636 and keep the hot combustion gases from escaping over those ends. As indicated by the arrows 640 those gases are thus guided over the insulation blocks 636 to cause those blocks to improve their heating effects.

If desired, panels 638 can have tabs struck out from their flat bodies to project over hold-down flanges 621 at the burner ends and hold thermal blanket sections over those flanges. Elongated burners are generally used to irradiate work that is passed transversely to their length and that does not extend beyond the ends of the burner. In such an arrangement there is not much to be gained by mounting wings 630 along those ends.

Figure 17:
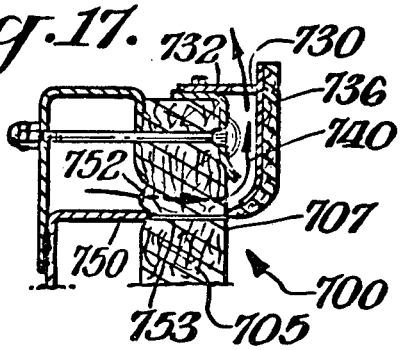
FIG. 17 is a sectional detail of yet another burner construction incorporating the present invention.

FIG. 17 shows a modified form 700 of the burner construction of FIGS. 13 and 15. Here the relatively cold air-seal gases discharged through the burner's matrix face are deflected away as shown by arrows 740, so that they do not significantly detract from the heating of a thermal block 736 mounted over the burner's edge. Block 736 is held, as by cementing, to a metal support 730 that has tongues struck out to form mounting lugs 732 by which the support is secured to the hold-down angle or to the burner side.

Block 736 is preferably arranged so that its inboard end touches the face 707 of matrix 705 at a location at which combustion mixture does not emerge from that face. That location is generally directly opposite the edge 750 that defines the inboard boundary of the air seal slot 752, but to make more certain of the location the matrix can be provided with an impervious internal stratum 753 that provides a barrier against spreading of the combustion mixture beyond the proper location. This barrier 753 can be a silicone rubber or other plastic layer provided the same way as the joint 53 in the construction of FIG. 1 with or without the help of a metal foil.

The burner of FIG. 17 is shown as operating with its matrix held in the vertical position, but it is also very well suited for operating face down. Similarly the burners of FIGS. 13 and 15 can also be operated facing laterally like the burner of FIG. 17.

Figure 18:
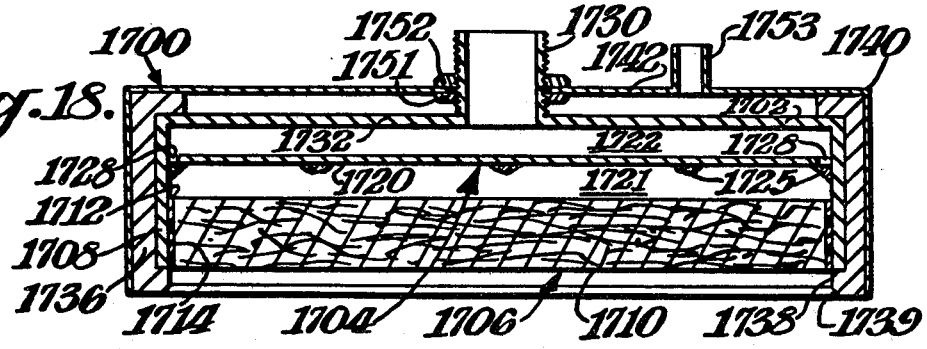
FIG. 18 is a sectional view of another form of burner illustrative of the present invention.

The burner of FIG. 18 is burner 1700 of parent application Ser. No. 952,332 oriented to fire face down. As there described burner 1700 operates well without an air seal. This burner has a body 1702 of relatively thick metal and shaped, as by welding together rectangular plates, to provide the combustion mixture plenum 1704. The mouth 1706 of the plenum body receives a ceramic fiber matrix 1710 which is shown with its edges adhered to the inside surface 1712 of the mouth by a cement 1714 that withstands temperatures at least as high as 400° F., preferably at least as high as 450° F. or 500° F.

A silicone cement is very effective for this purpose.

The mixture plenum is relatively shallow, only about an inch deep, and it is separated into upper and lower chambers by a partition 1720 extending across it. The partition is slightly smaller in length and width, than the plenum, and is tack-welded at spaced locations 1725 to the plenum walls so as to leave a narrow passageway 1728 around its periphery. A threaded connector 1730 is welded into an opening in the back wall 1732 of the burner to receive the combustion mixture, and another connector can be similarly provided for pressure measurement, if desired.

Burner 1700 is illustrated as also having its side walls 1708 surrounded by insulation. Preformed blocks 1736 of insulation that can be made of the same material as the matrix 1710, are shaped to fit against those side walls as well as over the top and under the bottom of each wall. Each block can run the full length of the wall it fits against, and the blocks can be mitered together at the burner corners. The blocks can be cemented in place, or strapped around the burner with baling straps or the like, or they can be held by an enveloping frame 1740. Such a frame need only be a very thin gauge metal sheet notched out at the corners and folded into the box shape shown. The frame can be cemented to the insulation blocks, or a baling strap can be clamped about the frame, or the frame can have its corners welded or crimped together to make a self-supporting structure that holds the insulation blocks in place and protects them against physical damage.

The frame can be secured as shown in FIG. 18 by providing its floor 1742 with an opening that fits snugly around connector 1730 and clamping it to that connector, between two nuts 1751, 1752 threaded to the exterior of the connector. An additional connector 1753 can also be fitted in the frame floor to deliver a cooling gas to the interior of the frame so as to cause the gas to pass through the insulation blocks and escape at the mouth of the frame to thus reduce the absorption of heat by the burner walls 1708 from the hot combustion gases.

As also shown in FIG. 18, the insulation blocks can have a nose 1738 that covers most or all of the upper edge of a burner wall 1708, to further impede the flow of heat to that wall.

The outermost projection of the insulation blocks 1736 can also be beveled as shown at 1739. This reduced the likelihood of physical damage at that location and also makes the projecting insulation face better reflect away incoming infra-red radiation that would otherwise reach the matrix face and tend to overheat it.

The elaborate protection features of FIG. 18 can be dispensed with. Thus a burner having a body made of aluminum about ⅛ inch thick operates very effectively without the help of any external insulation or air flow, and even if the burner is not equipped with the plenum partition 1720. Although the matrix 1710 is installed in such a burner as a slip fit so that it is only held in place by silicone cement or resin applied as a very thin film to the matrix edges and to the burner wall which it engages, the matrix remains securely held in place by the silicone through many hours of face-up operation with the outer matrix surface at 1600° F.

Removal of the matrix after such operation shows the silicone to be essentially undamaged, even at the lip where the silicone is in contact with incandescent matrix fibers. It appears that a metal wall ⅛ inch thick having the thermal conductivity of aluminum withdraws heat from the silicone layer so rapidly that it keeps the layer from heating up to the temperature at which it begins to be damaged.

Silicone layers about 40 mils thick may begin to be damaged where they are in contact with incandescent fibers, but if there is such damage it is confined to the portion of the layer most remote from the heat-withdrawing side wall and does not significantly impair the operation of the burner or shorten its useful life. Compounding the silicone with particles of finely divided metal such as aluminum or copper makes the silicone more readily conductive to heat and keeps it from being significantly damaged when in a layer as much as 60 mils thick.

Copper has a thermal conductivity substantially higher than that of aluminum and can be used in place of aluminum for the burner body. A copper body will provide the operation described above even when its wall thickness is only about 70 mils. Steel on the other hand has a thermal conductivity poorer than aluminum, and a steel wall thickness of about ¼ inch provides about the same results as a ⅛ inch thick aluminum wall.

In order to better allow for the simple sliding of a matrix in place in the burner of FIG. 18, the walls 1708 of the burner body are preferably joined together at the corners so as to present an essentially zero inside corner radius. Thus the body can be made from a square or rectangular metal sheet whose corners are notched out to leave four flaps projecting from a center panel. These flaps are then readily folded up to make the walls, and then joined together at their corners. They can for example be welded together with the welding effected at the external portions of the corners without deforming the inside aspect of the corners and without depositing weld metal on those insides.

Alternatively the walls can be joined at their corners by brazing, and even by cementing as with a silicone resin. Although such resins are frequently of rubbery or yieldable nature, the burner body metal is so thick that it provides adequate rigidity to burners whose wall corners are cemented together even when the burner faces are as large as one foot by two feet.

When the plenum partition 1720 is used and welded to the walls, it serves to greatly increase the rigidity of the burner body and make edge cementing practical for still larger sized burners.

A burner with the foregoing corner construction readily receives a matrix that is merely cut with its edges perpendicular and true, and no effort is needed to round off the matrix corners. Such a cut matrix is merely thinly buttered over its edges with the cement, a thin bead of cement is applied along the inside faces of the upper portions of the walls, the matrix is laid flat on a table top, and the burner body turned face down and lowered over the matrix until the burner lips also rest on the table top. The assembly is then permitted to stand an hour or so to allow the cement to cure, after which the burner is ready for use.

The burner without the external insulation and without the plenum partition can also be operated face down or with the plane of its matrix vertical, but the burner body is then subjected to heating by the rising hot combustion gases and becomes hotter than it does when operated face up. For such more rigorous operation, it is preferred that the matrix temperature be not over about 1450° F., or that the operation be discontinuous so that the temperature of no part of the burner walls reaches 500° F.

The application of external insulation to the exterior of the uppermost burner wall when the burner is operated tilted, or to the exterior surfaces of all walls when the burner is operated face down, keeps the burner body cooler. Such insulation need only be about ¼ inch thick but should be thicker when it is to be in the form of a fitted block as shown in FIG. 18. It is perfectly adequate in most cases however to merely wrap a strip of insulation blanket around all four outer walls of the burner, and strap the wrapped strip in place.

The use of the plenum partition 1720 also helps cool the side walls inasmuch as the partition causes all of the cold combustion mixture to sweep past the inside surfaces of those walls and thus cool them by an appreciable amount. A burner so constructed operates continuously face down without external insulation but with the maximum matrix temperature about 1500° F.

The cooling effect of the partition is increased by welding a greater proportion of its edge to the walls so that the partition helps conduct heat away from the walls. Also diminishing the depth of the plenum 1704 between the matrix and the burner back 1732 shortens the path by which heat is conducted from lips of the side walls back to the burner back and to the combustion mixture supply pipe, and this also helps cool the walls better. Thus the plenum depth can be made as small as ⅜ inch, the corners of the plenum can be beveled, and/or the matrix itself can be made relatively thin, 1 inch or ⅞ inch, to improve the rate of heat flow away from the burner lips.

With a burner floor about ⅛ inch thick, the connector 1730 need not be welded in place, but can be threadedly engaged in that floor. For this purpose the floor has a connector opening punched out, the edge of that opening threaded, and the connector then threaded into it. If desired the punching out of the opening can be arranged to also draw some of the metal out around the margin of the opening and thus leave the metal edge of the cut longer than the original floor thickness. This provides a longer distance for the thread to extend over at the cut, and strengthens the threaded connection to connector 1730.

The matrix 1710 is not required to be a slip fit in the burner mouth, but can be a tight fit that calls for forcing the matrix into place with its edges squeezed against the burner walls. Such a forced insertion generally squeezes out some of the resin that may be buttered over the matrix edges, so that it is then desirable to use a little extra resin for this arrangement or to use a matrix that has its edges pre-treated with resin that is allowed to cure or partially cure, and then butter the thus cured edges with less resin.

Alternatively the matrix can be loosely cemented to the side walls while those walls are not fully bent over to their final position, and the walls subsequently bent to the final position to thus squeeze against the matrix edges. Such a final bending can bring the walls a few degrees past the perpendicular so that they taper toward each other and thus lock the matrix in against being blown out by the pressure in the plenum.

The inner faces of the side walls can also be provided with cooling fins, particularly when a plenum partition is used, to further improve the transfer of heat from the side walls to the combustion mixture passing through the plenum. Such fins are readily provided by casting the burner body.

The burner of FIG. 18 can also be provided with wings and associated thermal radiation blocks as in the construction of FIG. 15.

The burners of the present invention are particularly suited for heating materials such as wet textile webs to dry them, or latex-coated carpet backs to dry and cure the latex, or paper or paperboard webs to dry them and/or cure coatings applied to them. Thus a single burner having the construction of FIG. 15 will dry and cure a 1/16 inch thick latex layer on a carpet back moving under the burner at a rate that gives the latex a five-second exposure with the burner face held at about 1400° F. 5 inches away. For drying wet textile fabrics such as used in clothing, the burners of the present invention are generally used in a pre-drier to subject freshly dyed wet fabric to about 4 to 10 seconds of irradiation to matrix faces held at about 1450° F. This sets the dye and partially dries the wet fabric, the remainder of the drying being effected in any desired way, as for example by the standard steam-heated rollers or by burners having a matrix face temperature of about 1100° F.

It is generally desirable to have the burners located below the work being irradiated inasmuch as the burner body is then not subjected to so much heating and the rising hot combustion products remain longer in contact with the work thus increasing the heating effect. In some cases however the only practical installation has the burner firing face down over the work.

Figure 19:
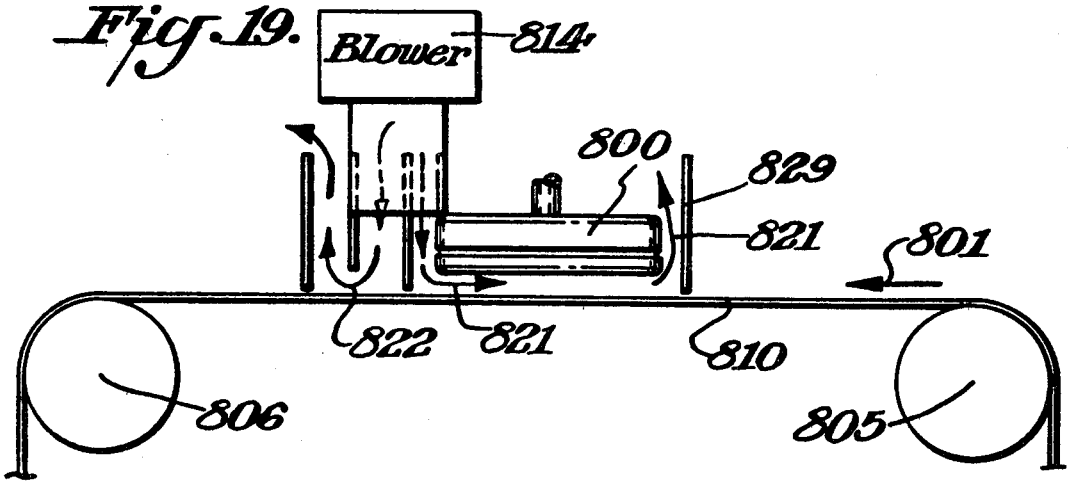
FIG. 19 is a schematic side view of a burner set-up for assisting in the drying of a moving web of material such as paper.

FIG. 19 shows an installation of this type in a portion of a paper-making machine preceding all or most of the steam can driers. A paper web 810 120 inches wide is here illustrated as moving in the direction of arrow 801 between two rollers 805 and 806. Over the web is positioned a burner 800 firing face down. To assist in the removal of moist air from adjacent the burner and thus speed the drying action, a blower 814 is arranged to blow a stream of low-humidity air between the burner and the web, as indicated by the arrows 821. This stream moves longitudinally of the web and transversely of the burner, countercurrent to the paper movement, and a baffle 829 can be provided to help deflect the stream away from the web after the air in it has become heavily laden with moisture.

Another stream of dry air 822 can be used to flow in the opposite direction along the web to further help remove from adjacent the web the moisture vaporized by the heat treatment. The burner and blower assembly can be placed under the web 810 facing upwardly, or two such assemblies can be used, one facing down from above and the other facing up from below.

Figure 20:
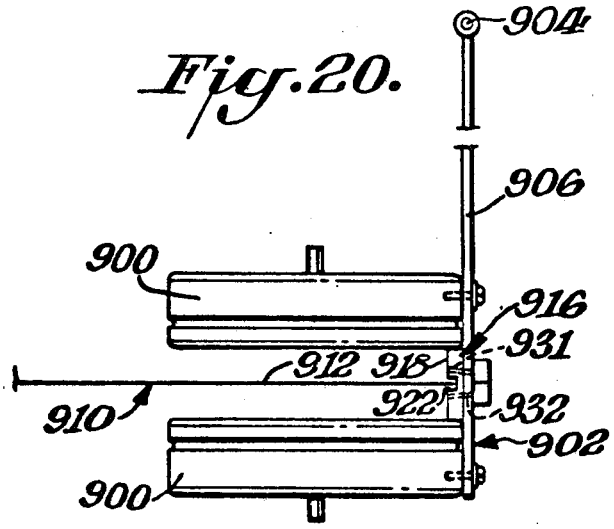
FIG. 20 is a schematic front view of a modified burner arrangement for assisting in the drying of an edge portion of a paper web passing through a standard drier.

The construction of FIG. 20 is used to help dry one or both edges of a paper web. The drying of freshly manufactured paper in standard driers sometimes causes the central portion of the paper web 910 to dry more rapidly than the outermost few inches of the edges 912. According to the present invention narrow burners 900 are placed over and/or under one or both edges 912 to more closely equalize the drying.

In FIG. 20 two burners 900 are shown as held on an outer carry plate 902 that is pivoted from overhead pin 904 by means of an elongated beam 906, so that the burners can be pivotally retracted from the illustrated position, to simplify the threading of the paper web 910 through the drier. The burners are easily restored to their illustrative operative position where they are latched in place.

The fuel supply conduits to the burners 900 are made flexible to yield with the foregoing pivotal action, or the conduits can be provided with swivel joints, the swivel axes of which are aligned with pin 904, so that the portions of the conduits secured to the burners can pivot with the burners. Where the burners have air-seal margins as in FIGS. 1, 10 and 13, a blower can be mounted on one of the burners 900 or on carry plate 902 or beam 906, to supply a stream of air for the air-seals, and if desired all the air for the combustion mixtures as well.

Carry plate 902 is also shown as holding a pad 916 of thermal insulation such as one made of felted ceramic fibers. This pad is not needed, but if used improves the drying efficiency by acting as an absorber and re-radiator of infra-red rays. It absorbs infra-red radiation emanating from the faces of burners 900 and its surface 918 becomes quite hot in doing so. This hot surface re-radiates infra-red energy to the surfaces of paper edge 912 without losing much heat by conduction to the relatively cool carry plate 902. Pad 916 can be grooved as shown at 922 to permit the paper edge to completely block direct radiation from one burner face to the other.

Passageways 931, 932 can be provided through the carry plate 902 and through the pad 916, so that the faces of the burners can be observed and thus monitored to assure proper operation. Automatic monitoring can be arranged by fitting a light or ultra-violet sensor to the passageways, and connecting them to automatically shut off all fuel flow to a burner whenever the burner face is not lit. For lighting the burners electric ignition such as shown in U.S. Pat. No. 4,157,155 can be used, or if desired pilot flames, with manual controls to override the sensors.

Where two burners 900 are used at one edge of the paper, they can be located face-to-face, or they can be offset so that they do not radiate directly at each other in the event the paper web 910 tears or its edge 912 is damaged or missing. Such direct counter-radiation can rapidly damage the burner faces, particularly if those faces are ceramic fiber mats, and to guard against such damage a photoelectric web edge detector can be located upstream from the burners and connected to shut off the flow of fuel to one or both burners when the edge 912 is missing from the paper web.

A similar safeguard can be used to extinguish both burners when the paper web 910 stops or slows down excessively. Even relatively low-temperature operation of the burners can rapidly scorch a stopped paper web.

Figure 21:
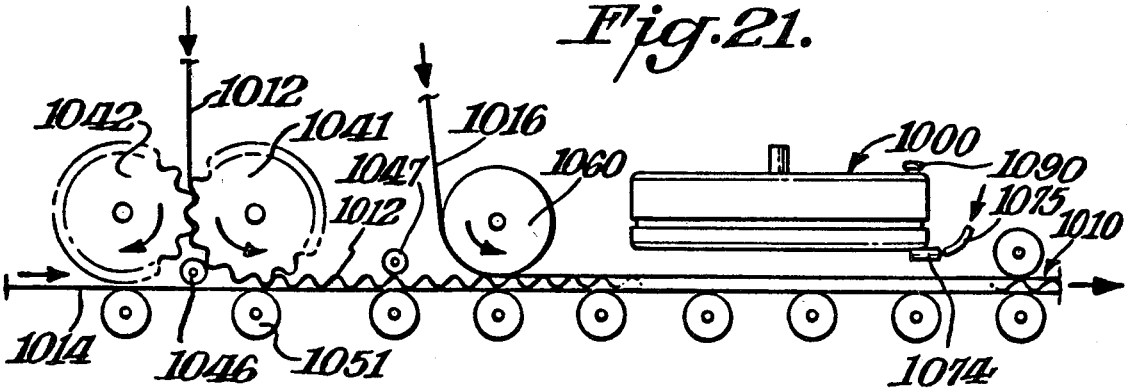
FIG. 21 is a schematic side view of a heating system for the preparation of corrugated board.

FIG. 21 illustrates the manufacture of corrugated board 1010 from a corrugated core sheet 1012, a lower face sheet 1014, and an upper face sheet 1016. Corrugating rollers 1041, 1042 corrugate the core sheet 1012 where these rollers mesh, and roller 1041 carries the corrugated sheet past an applicator roll 1046 that applies adhesive to the lower edge of each corrugation. Roller 1041 also presses the thus coated core sheet against the lower face sheet 1014 which is supported by a backing roller 1051.

Face sheet 1014 with the corrugated core sheet adhered to it moves to the right as shown in this figure, carrying the top of the core sheet past a second applicator roll 1047 which applies adhesive to the top edge of each corrugation. This assembly then is covered by the top face sheet 1016 introduced around roller 1060. This roller cannot press the top face sheet against the adhesive-coated corrugation as much as the lower face sheet is pressed at roller 1051, so that the adhesion of the top sheet is best reinforced by the application of heat.

To this end a burner 1000 is shown as held above the face sheet just downstream of roller 1060, firing downwardly onto the face sheet. Only a few seconds exposure to such heating will set the top face adhesive. Heating can similarly be provided for the lower face sheet if desired. Also the freshly assembled sheets can be gripped by continuous conveyor belts pressing against one or both face sheets to more securely keep the sheets pressed as they advance to the heater and are withdrawn from it.

Figure 22:
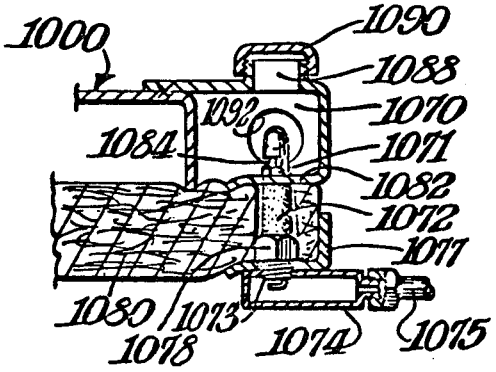
FIG. 22 is an enlarged detail view of a pilot gas jet construction in FIG. 21.

Burner 1000 is shown as provided with an electrically lit gas pilot light and this detail is more fully illustrated in FIG. 22 which is on an enlarged scale. Here the air-seal plenum 1070 at one edge of the burner is shown as receiving the connector end 1071 of a spark plug 1072 whose electrode end 1073 projects into a pilot gas tube 1074 to which is fed at 1075 a supply of gas or of a gas-air combustion mixture.

The wall of gas tube 1074 is punched out and threaded to threadedly receive the thread at the electrode end 1073 of the spark plug. The lower flange of mounting angle 1077 is punched to pass the threaded end 1073 but not to pass the relatively wide shank portion 1078 of the spark plug. That shank passes through the burner mat 1080 and through a punched opening in the shelf 1082 that supports the mat. A square or hexagon end 1084 of the shank is exposed in the plenum 1070 so that it can be rotated by a wrench to tighten and secure the pilot tube 1074 as well as the spark plug against the edge of the burner face.

To make the drive end 1084 accessible to such a wrench, the plenum 1070 has a back opening 1088 which can be covered as by a threaded-on cap 1090 which is removed when the wrench is to be inserted. In addition an electric lead wire can be threaded through the plenum 1070 and snapped over the connector 1071 to energize the ignition. Such lead wire can extend out through the air supply duct 1092 that brings air to plenum 1070 at a corner of the burner. Alternatively the ignition wire can be fitted through the back opening 1088, and that opening also used to admit the air-seal air. In either arrangement the ignition wire can be threaded through a sufficient length of the air-supply duct so that the wire is not exposed to very dusty conditions that can prevail at or close to the burner.

A carefully insulated feed-through connector can then be fitted to the air-supply duct at a remote location, and the ignition wire connected to the internal terminal of such connector, with its external terminal connected to the source of ignition current.

The infra-red energy radiated by ceramic mat burners has a very high power density. It can for example cure a polymerizable silicone coating with as little as 5 seconds of radiation. It is also very effective for heating thermal insulation such as other ceramic mats and to heat up the interiors of ceramic mats that are somewhat transparent to infra-red. Thus in the manufacture of some ceramic fiber mats, the fibers are lubricated by fats or the like and such lubricants are easily driven out by irradiating such mats with the concentrated infra-red energy of a ceramic mat burner. A stream of air can be passed through the mat being heated from its irradiated face to its opposite face, inasmuch as this helps heat up the interior of the mat and thus speeds the driving off of the lubricant.

Figure 23:
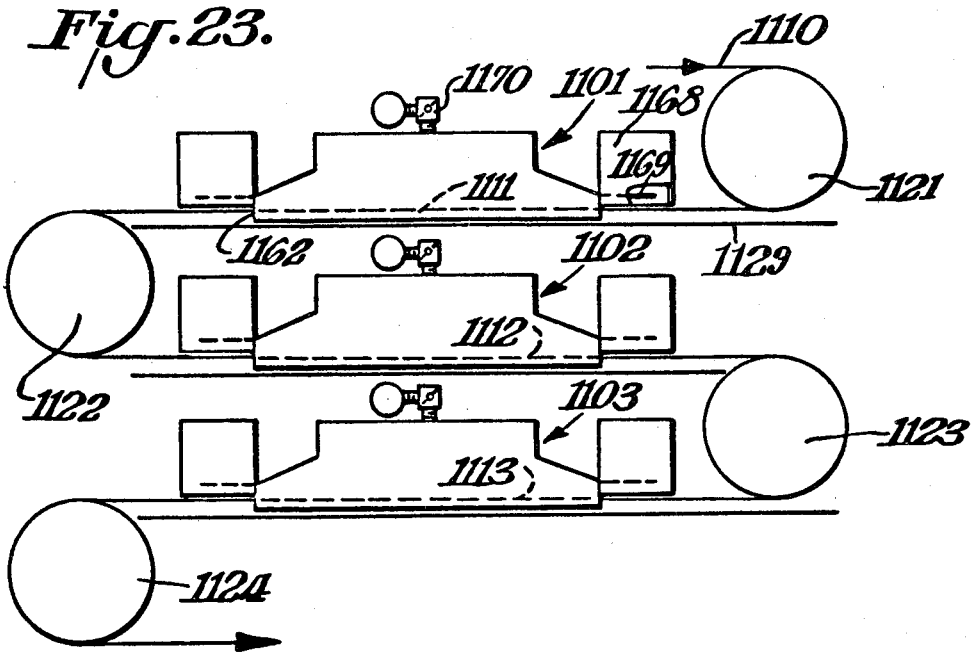
FIG. 23 is a side view, somewhat schematic, of another type of paper drying apparatus representative of the present invention.

The apparatus of FIG. 23 has a series of rows of downwardly-facing burners, three rows of which are shown at 1101, 1102 and 1103. A web of wet paper 1110 makes a series of passes at 1111, 1112 and 1113 below the faces of the burners, with the help of reversing rolls 1121, 1122, 1123 and 1124. The paper can then be wound up, or if further drying is needed can be exposed to additional burners or looped over steam cans or other drying equipment. If desired all or some of the reversing rolls 1121–1124 can be internally heated as by steam or other fluid, to make the drying apparatus more compact.

Figure 24:
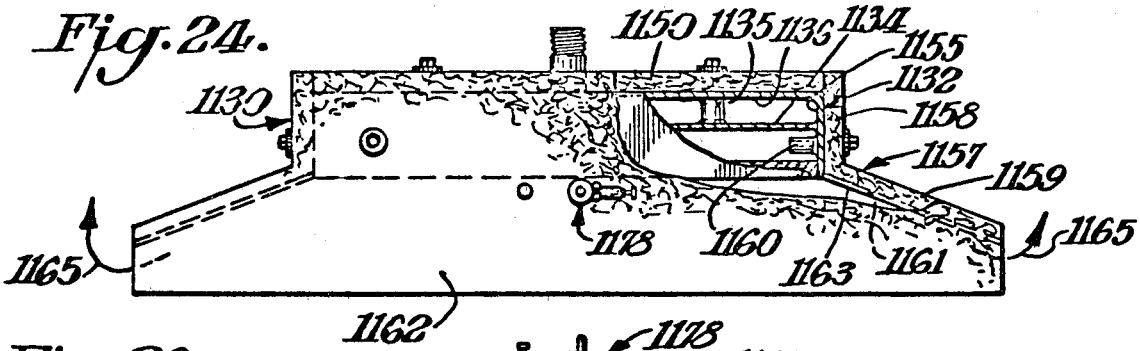
FIG. 24 is an enlarged side view of one of the burners of FIG. 23, with parts broken away to better show internal details.

Each row of burners has a set of relatively small side-by-side individual burners 1130 similar to the burner of FIG. 18. As in FIG. 18, burner 1130 has a generally rectangular metal body 1132 of metal like aluminum that conducts heat very well, and with a wall thickness of about ⅛ inch so that it is thick enough to effectively conduct away excessive heat. In FIG. 24 the burner has a combustion mixture deflector plate 1134 supported by posts 1135 secured to the plate and to the back wall 1136 of the burner body. The burner body, plate, and posts are preferably brazed together, as by the molten flux dip brazing technique described in Section 75, pages 2–3 and 15 of Tool Engineers Handbook, 2nd Edition, published by McGraw-Hill Book Co., Inc. and copyright 1959 by American Society of Tool Engineers.

One very effective brazing arrangement uses posts 1135 that have mounting bosses 1137 and 1138 fitted into tapered mounting apertures 1139, 1140, in the back wall of the burner and in the deflector plate, respectively. The bosses are then staked over so that everything is held together in proper orientation, for the molten flux dip brazing step. Brazing paste is then applied to the locations to be brazed, and the assembly dip brazed. The brazing paste can thus be applied to the joints 1141 between posts 1135 and the deflector plate, as well as the joints 1142 between the posts and the back wall of the burner body, in addition to the joints between the side walls 1144 of the burner body where those side walls are formed by bending down suitably shaped extensions of the back wall. The separate members can be clamped in place with suitable clamping jigs so that they are not significantly distorted in shape or position by the heat of the dip brazing.

Posts 1135 can also have counterbores 1145 drilled into them from their outer faces so as to provide engagement sites for mounting fasteners. When the posts are made of aluminum it is helpful to thread the counterbores and then fit steel wire coils 1146 into the resulting threads to provide a more secure anchorage for threaded bolts or studs.

Figure 25:
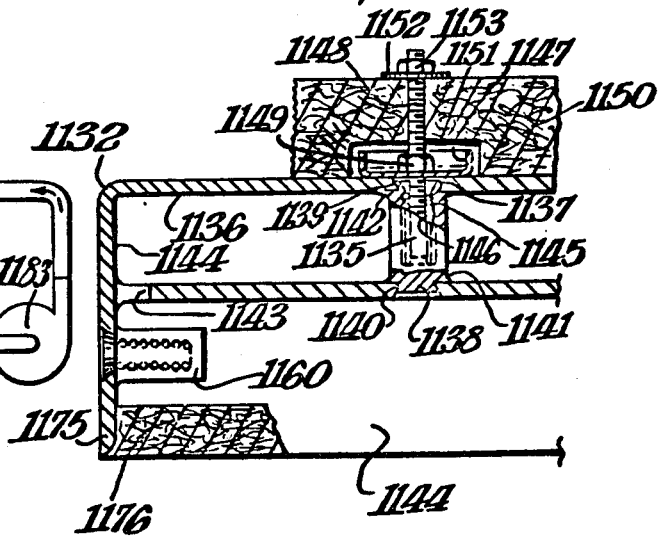
FIG. 25 is a further enlarged detail view of a burner support in the construction of FIGS. 23 and 24.

Posts 1135 can be used to hold thermal insulation pads or blocks against the outside of the burners, and also hold mounting members that position the burners in their proper locations. FIG. 25 shows a mounting channel 1147 secured to a post 1135 with a threaded stud 1148 that is threaded into the post and a nut 1149 that is threadedly locked down against the web of channel 1147 after the channel, previously punched through to receive the stud, is fitted over the stud.

The same stud can also be used to hold an insulation block 1150 against the back of the burner, after the block is grooved as at 1151 to make room for the channel, and drilled to fit over the stud. A washer 1152 and outer nut 1153 then lock the block in place. Where the insulation is a yieldable pad, pregrooving and/or drilling may not be needed.

A single insulation block or pad can cover the backs of an entire row of burners, if desired, or can cover a single back or any other number of adjacent backs.

Figure 26:
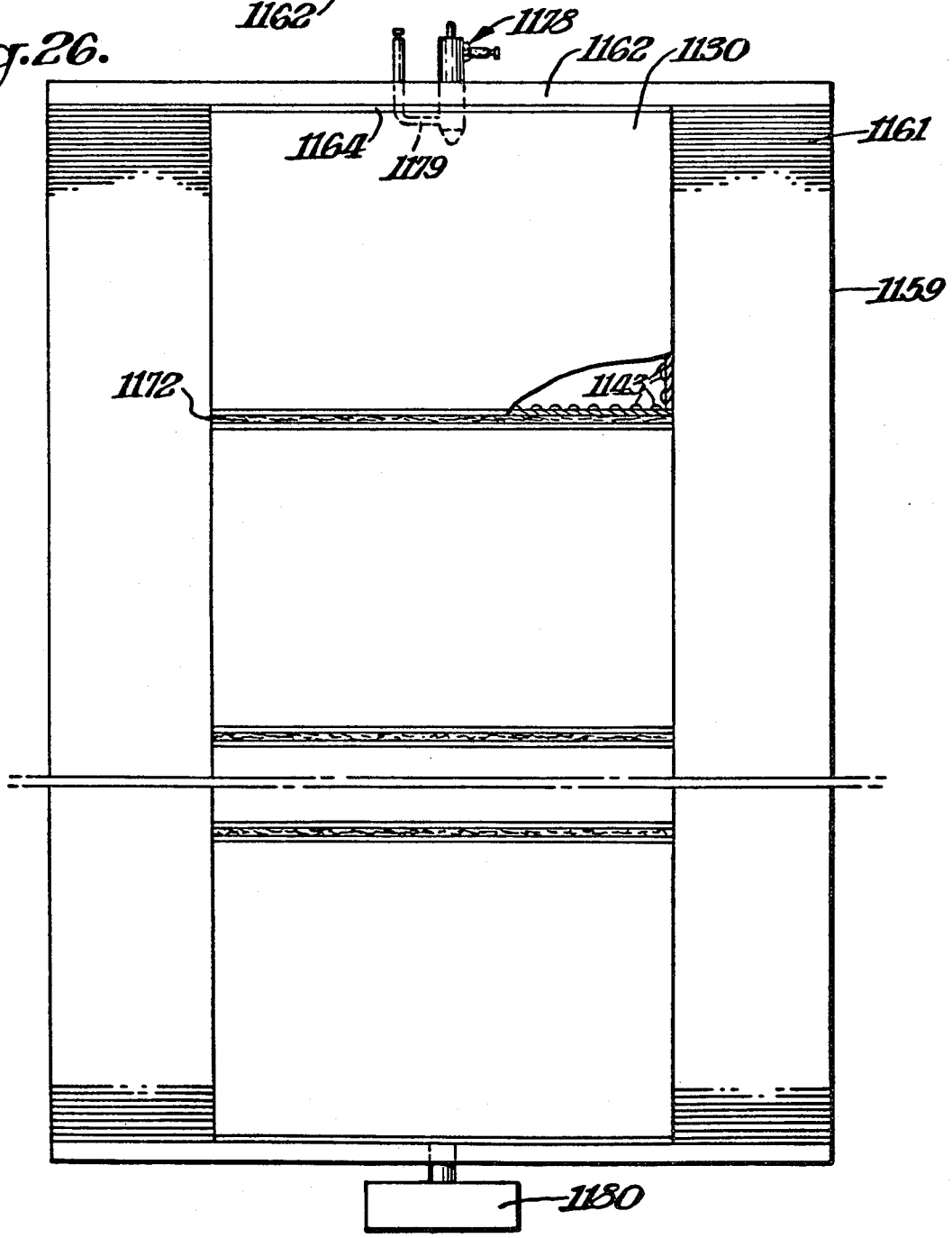
FIG. 26 is a plan view of the faces of a row of the burners of FIG. 23, looking up at them from below.

The burner sides 1155 that are aligned to make the leading and trailing burner edges across which the paper 1110 moves, are shown in FIGS. 24 and 26 as fitted with insulation blocks 1157 that are molded into angularly related flanges 1158 and 1159. Flanges 1158 are clamped against sides 1155 with the help of posts 1160, similar to posts 1135 that are only secured to the burner side walls. Insulation flanges 1159 flare outwardly from the burner faces, preferably at an angle of about 60 to 80 degrees from the vertical. The lower face 1163 of these flaring flanges can have its surface area effectively increased as by a succession of adjacent grooves 1161. The width of flanges 1159 is preferably from about $\frac{1}{3}$ to about $\frac{1}{2}$ the width of the burners, in order to take full advantage of the heating effects of the hot combustion gases discharging from the burner faces when the burners are operating.

As shown in FIGS. 23, 24 and 26, the hot combustion gases are kept by thermal deflectors 1162 from escaping over the free edges of the burner walls 1164 at the ends of each row. Deflectors 1162 can be mounted to walls 1164 the same way blocks 1157 are mounted, but the deflectors preferably extend downwardly lower than the bottom edges of blocks 1157, to a level below the path of the paper 1110. The hot combustion gases rise and will accordingly flow upwardly around the bottom edges of blocks 1157, as shown by arrows 1165.

FIG. 23 also shows exhaust ducts 1168 that collect the hot combustion gases which can then be used as a heat source for, other operations, or to pass through rolls 1121–1124 to heat them. Ducts 1168 can be provided with baffles 1169 that direct the hot gases over a few more inches of the paper 1110 before those gases are withdrawn. The infra-red drying of paper is particularly more effective than steam-heated drying rolls, when it is applied to the dry end of the papermaking line. Thus steam-heated drying rolls that deteriorate to the point they cannot safely contain steam at superatmospheric pressure, can be replaced by infra-red radiators of the present invention, or can be shifted to the dry end of a dryer and infra-red radiators can be mounted alongside them to dry or help dry paper threaded over these deteriorated rolls.

Each individual burner of a row can have its own feed trimming valve 1170 that can be adjusted to offset uneven heating effects that may be caused by differences in the porosities of the matrix faces of adjacent burners. The burners in each row can be mounted with their adjacent sides in direct contact, but preferably a compressible pad 1172 of thermally resistant material such as ceramic fibers is fitted between adjacent burners. Such a pad about $\frac{3}{8}$ inch thick compressed to half that thickness does not make too much of a gap in the incandescent surface defined by the burner faces, and it also helps to keep the burner-to-burner joints plugged against the leakage of hot combustion gases as a result of thermal expansion during operation.

The gaps between individual burners of a row can have their radiation interrupting effects reduced by shaping the burners so that these gaps extend at an angle with respect to the direction of paper movement. This will spread the radiation interrupting effect over wider portions of the paper, or even over the entire width of the paper.

The radiation interruption at the gaps is also reduced by tapering the edges of the burner side walls, as shown at 1175 in FIG. 25. The burner matrixes 1176 are sufficiently resilient that they can be squeezed into place against such tapered walls and thus effectively reduce the width of the outer edge of the wall to about 1/16 inch even though the balance of the wall is about $\frac{1}{8}$ inch thick.

The movement of the hot combustion gases over the flared surfaces 1163 heats up those surfaces to temperatures that come close to the temperature of the incandescent burner faces, particularly when those surfaces are of low density thermal insulation. The resulting high temperature of surfaces 1163 will accordingly generate additional infra-red radiation that helps dry the paper 1110. This additional drying is provided without increasing the amount of fuel used, so that the fuel efficiency is greatly improved.

The deflector plate 1134 can be mounted in its burner in other ways. For example, this plate can have integral tangs projecting from its edges and received in closely fitting sockets in the burner side walls. The tangs need only project about 1/16 inch, or enough to hold the plate in place during the dip brazing treatment. The brazing action will then not only braze the plate in place but braze the tangs to the sockets to make the brazed-in tangs air-tight plugs for their sockets. To further assure air-tightness, the sockets can be shallow recesses that do not penetrate completely through the burner walls.

A tanged plate can be mounted in place by pushing it into the open mouth of a burner formed by punching and bending a single metal sheet, before the side walls bent from the sheet are fastened to each other as by brazing or welding. The pushing into place will cause the tangs to spring the unfastened side walls outwardly so that the plate will slide into position. If desired the side walls can be sprung out slightly before the plate is pushed in, as by inserting hooks into the side-wall openings for the mounting posts 1160. The plate should then have the scalloped cut-outs 1143 in its edges arranged so that cut-outs are aligned with the openings for the posts 1160, and the plate can be pushed past the hooks. After the plate is in position the hooks can be released to permit the walls to spring back into locking engagement with the plate.

A burner matrix can be easily damaged as for example by a tool that is inadvertently poked into or through it, or by a water jet from a high pressure water line such as conventionally used to clean and hose down machinery. To minimize the damage that may be caused by a failure of the matrix, the combustion mixture plenum is preferably fitted with a sensitive pressure switch that responds when the pressure in the combustion mixture plenum drops sharply form the normal operating value. Thus the normal operating pressure in the combustion mixture plenum can be on the order of 4 to 5 inches of water column, and a failure of the matrix is generally associated with the ignition and detonation of the combustion mixture in the combustion mixture plenum. This explodes outwardly a portion of the matrix and the plenum pressure then drops to about 1 inch or less of water column. The ignition and explosion leaves the combustion mixture burning freely in the combustion mixture plenum, and if such burning is permitted to continue for any length of time the interior, back and upper walls of the burner can be overheated and can warp sometimes rather badly.

The pressure switch can be connected to immediately shut off the combustion mixture flow to the burner when there is the foregoing drop in combustion mixture plenum pressure. This shut-off will also put out the flames and thus prevent damage to the burner body. The matrix can then be replaced and the burner quickly returned to use. Had the burner body been permitted to warp, the entire burner generally would have to be replaced, and such replacement may involve extended delay because the burner would have to be remanufactured and shipped to its destination.

The pressure-sensitive switch can be energized by an electric current that is applied after the combustion mixture flow has commenced and has built up to the operating pressure in the combustion mixture plenum. Generally a large blower is connected to supply the air at the necessary pressure for the combustion mixture, and the stream of air thus supplied is arranged to be mixed with the gas that completes the mixture, and the resulting mixture fed to trimming valves 1170. Automatic igniting equipment is then conveniently used to open the flow of combustion mixture into the combustion mixture plenum, and it only takes a few seconds for the combustion mixture to so build up to its operating pressure there. When the automatic combustion equipment detects the presence of flame on the outer surface of the matrix it automatically shuts down its ignition, and this shut-down provides a signal for energizing the pressure-sensitive switch in the combustion mixture plenum. It is only after such energizing that such switch will respond to cut off the mixture flow when the matrix fails.

FIGS. 24 and 26 further show the provision of a burner igniter in the form of a spark-fired pilot flame director 1178 as in FIG. 22. This can be provided with its own flame-detecting rod 1179, or if desired an ultraviolet detector 1180 can be fitted at the opposite end of a row of burners, to detect burner operation when the burners are being lit, and automatically shut down the gas feed if the burners do not ignite or if they should be inadvertently extinguished.

Figure 27:
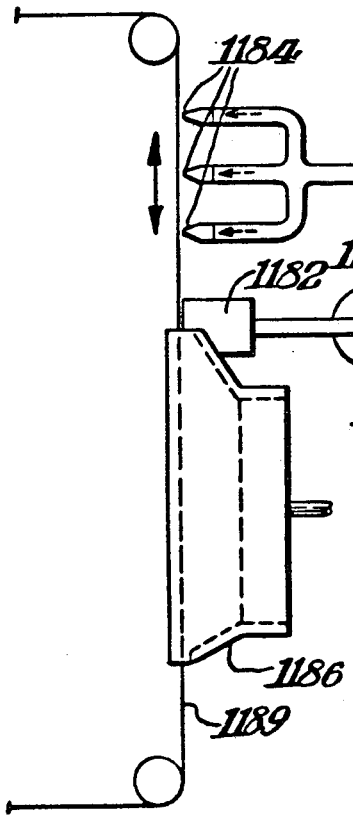
FIG. 27 is a side view, also somewhat schematic, of a further embodiment of paper-drying apparatus incorporating the present invention.

As illustrated in FIG. 27, the arrangement of FIGS. 23–26 can also be used to heat paper or other webs that are moving vertically rather than horizontally. In such an orientation the hot combustion gases need not flow downwardly out of the bottom edges 1186 of the burner units, so that those edges can be relatively short lengths of insulation that are horizontal or only mildly flared—about 20 to 30 degrees down from the horizontal. Those lower edges can also be brought relatively close to the moving web 1189—about ½ inch—to limit the ingress of ambient relatively cool air into the hot combustion gases.

To improve the heating effect of the hot combustion gases they are withdrawn through a top exhaust duct 1182 and propelled by a blower 1183 to jets 1184 from which those hot gases are jetted against the moving webs 1189. This breaks up the boundary layer barrier of steam or the like that can be present on the web.

The rolls on which a web is carried through a drier can also have their web-engaging faces perforated, with hot combustion gases blown through the perforations so they forcefully impinge against the web and thus help dry it. The rolls can have gas-fired burners, such as those of FIG. 10 or FIG. 18, fitted inside them to directly heat their web-engaging walls from the inside, rather than rely on heating with steam, and those walls are then preferably made of aluminum whether or not they are perforated. Alternatively such a burner can be placed alongside a portion of a roll that is not covered by the web it carries, to heat that wall from the outside.

The burners of the present invention dry paper with particular effectiveness. The radiation they emit is about as efficient in removing the last bit of excess water from an almost bone-dry paper, as it is in removing the first bit of water from a very moist sheet, and this permits an unexpectedly sharp drop in the bulk of a paper dryer.

However textile webs of cotton, wool, polyester, rayon, polypropylene, dacron, and the like, or mixtures of such fibers, as well as plastic films, are also very efficiently dried or cured with such burners.

A guide, such as plate 1129 in FIG. 23, can be used to assist with the threading of web 1110 past the burners in preparation for a drying run.

The grooving 1161 preferably has a depth of at least about ⅛ inch, and this depth can be as much as ½ inch. The grooving effectively increases the surface 1161 as compared to a perfectly flat surface, and an increase of at least about 50% is desired. To this end the profile of the grooves can be triangular, rectangular, sinusoidal, or have any other shape.

The combustion gases discharging from the far ends of the surface 1161 can still be sufficiently hot to warrant their use as for heating a further radiating surface. Thus those gases can be sucked through a porous insulator such as a ceramic fiber matrix positioned as an outer extension of surfaces 1161. The resulting relatively forceful flow of still hot gas through the porous matrix heats it up more effectively than the surface 1161 is heated, so that the heated face of the porous ceramic fiber matrix can contribute a significant amount of additional infra-red radiation.

The heated ceramic fiber surfaces whether of the burner matrix or of the surface 1161 or the porous extension for surface 1161, can have its infra-red emissivity improved by impregnation with well-known improvers such as a mixture of nickel and chromium oxides. Such impregnation can be effected by spraying an aqueous solution of nickel and chromium nitrates in the proportion of 4:1 by weight for example, onto the surface of the respective members and then heating those surfaces to decompose the nitrates.

The use of the surfaces 1161, with or without the foregoing extensions improves the operation of any fuel-fired burner that generates hot combustion gases.

Thus burners 1130 can be replaced by ceramic tile burners, metal screen burners, or ceramic cup type burners, or even direct flame burners, and in each case the burner operation shows a similar improvement.

Figure 28:
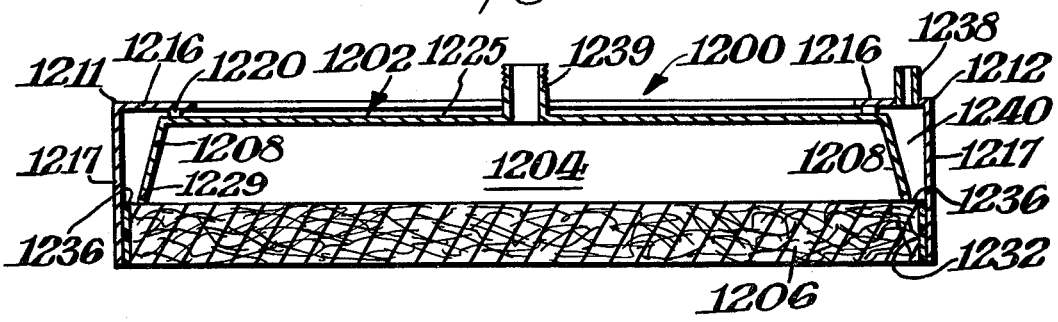

FIG. 28 illustrates a burner 1200 having a sheet metal body 1202 defining a combustion mixture plenum 1204 the mouth of which is covered by a ceramic fiber mat 1206. The burner body 1202 is of box shape, rectangular in plan view, and each of its four sides carries a sheet metal angle, two of which are shown at 1211, 1212. Each angle has a horizontal flange 1216 and a vertical flange 1217, the horizontal flange being spot-welded at 1220 to the back wall 1225 of the burner body. The spots of the spot-welds can be spaced from each other as much as an inch or more since there is no need to make the attachment gas-tight. However the attachment can be made by gas-tight welding, if desired, or even by brazing.

The burner body 1202 has side walls 1208 that flare outwardly about 15 or 20 degrees from the vertical and extend about 1 or 2 inches down from the burner back wall 1225. The vertical flanges 1217 of the angles 1211, 1212 depend about an inch or so below the lower edges 1229 of the body side walls 1208, to define cementing sites 1232 for receiving the edges of mat 1206. The mat can be cemented in place in the same manner described in application Ser. No. 952,332.

Edges 1229 are spaced a very small distance, preferably about ¼ to about ⅜ inch, from the vertical flanges 1217 to leave a slot 1236 between them through which slot air-seal air or other non-combusting gas is discharged from the plenum 1240 defined by the angles 1211, 1212. This spacing also locates edges 1229 in place to act as positioning stops against which the mat 1206 is held when it is being cemented in place. This simplifies the cementing operation.

It is also helpful to have spacers mounted to the edges 1229, or to the opposed inner face of flanges 1217, to help make sure the desired slot width is maintained at 1236. Spacers can alternatively be formed as an extra horizontally directed lip bent out at edges 1229, which lip is perforated with a large number of closely spaced holes.

An air-seal stream only about ⅛ inch thick is sufficient when blown through the mat alongside the cemented edges, to assure that the cement is not destroyed by the heat generated when the burner is in operation. The cement is accordingly preserved even when the sheet metal of the angles 1211, 1212 is a relatively poor conductor of heat, such as stainless steel about 50 mils thick. The cement need not withstand temperatures above 350° F., when it is confined to a zone within about ⅛ inch of the metal face 1232, and the slot 1236 is ¼ inch wide.

An inlet connector 1238 can be provided in flange 1216 or 1217 of one or more of the angles, for the introduction of air-seal gas. A combustion mixture inlet 1239 is also provided for the introduction of combustion mixture into plenum 1204. A baffle, not illustrated, can also be mounted in plenum 1204 to deflect the incoming combustion mixture as shown in the earlier applications.

Figure 29:
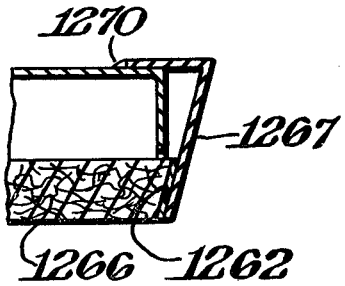
FIGS. 28 and 29 are vertical sectional views of still further burner constructions of the present invention.

Instead of outwardly flaring the side walls 1208, they can be made perpendicular, and then the flanges 1217 of the angles 1211, 1212 can be inclined inwardly. Such a construction is shown in FIG. 29 where angle flanges 1267 incline about 20 degrees. In this construction the inclination extends to cementing face 1262 and thus acts as an obstruction against downward movement of the mat 1266. This relieves the cement of much of the stress required in the construction of FIG. 28 to keep the mat from being blown out by the pressure of the combustion mixture in the combustion mixture plenum.

The FIG. 29 construction can be made with flanges 1267 relatively springy so that they can be pried outwardly to permit the insertion of the mat, after which the flanges are released to return them to mat-engaging position. The angles can then be welded or cemented to each other at the four corners of the burner body. Alternatively all the burner components can be assembled in position and then an external weld can be applied along connection line 1270.

The burners of the present invention provide very good radiant heating operation even when facing upward in dusty atmospheres. Combustible particles such a polyethylene are burned away as they fall on the burner matrix, and do not significantly affect the operation. The most serious effect of a dusty atmosphere is generally to disable an electric ignition attachment, and this can be minimized by running the electric current leads from the ignition site through to the air-seal plenum and then along that plenum and out through the air supply conduit connected to that plenum. At a location sufficiently remote from the dusty burner location the ignition wires can be run out from the air supply conduit and connected to the electric ignition control assembly.

Figure 30:
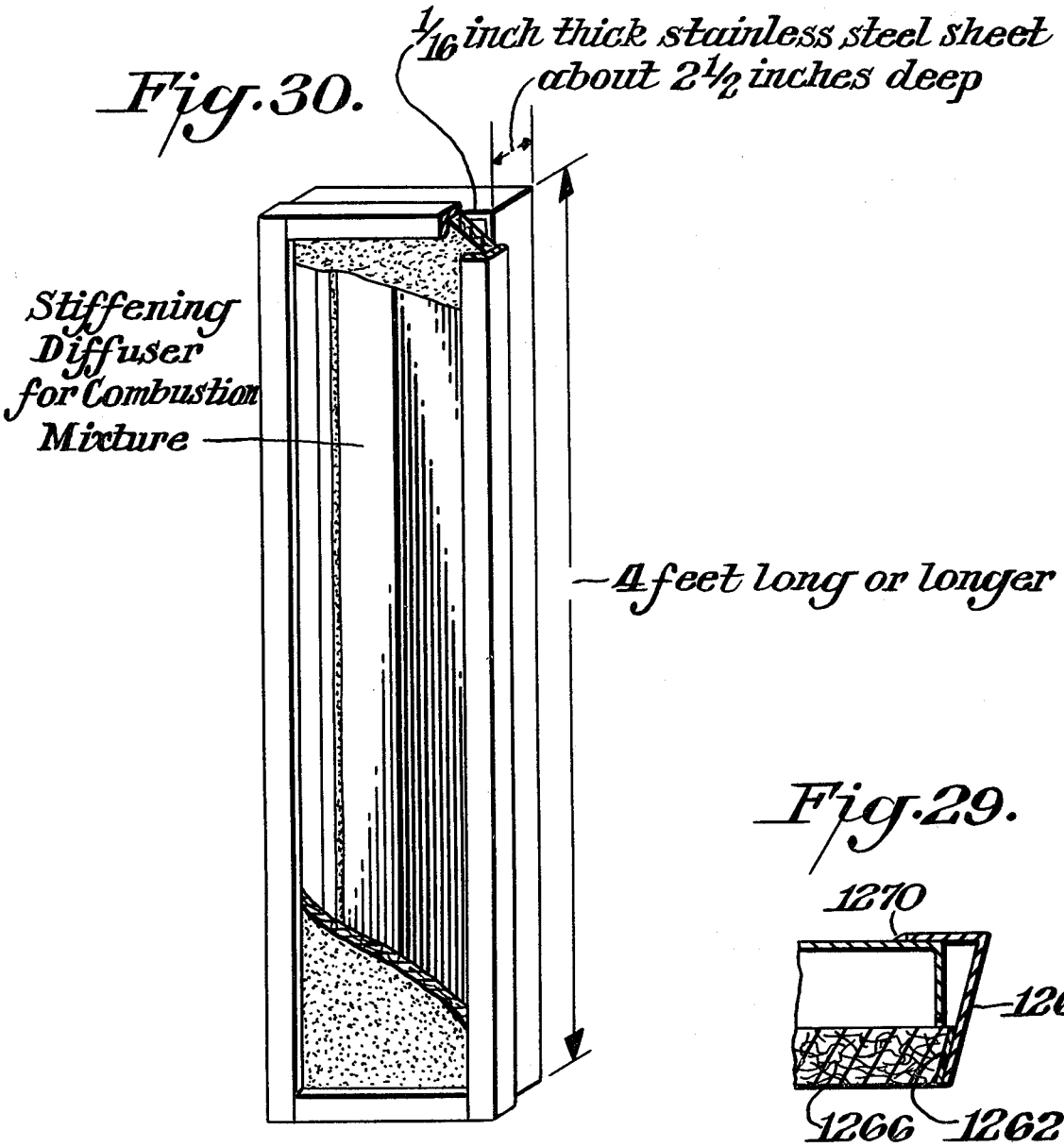
FIG. 30 is an isometric view of a modified burner of the present invention, with parts broken away.

It is also helpful to reduce the curling or twisting effects caused by differential heating of portions of a burner. Thus burners that are about 4 feet long or longer are best built with extra stiffeners welded onto the burner body and these stiffeners are preferably welded to the inner face of the plenum where they are kept cool by the flushing action of the combustion mixture. A seven-foot-long and one-foot-wide burner body about 2½ inches deep, will show little or no curling even though made of 1/16 inch thick stainless steel sheet, when there is welded to the inner face of its combustion mixture plenum a stiffening diffuser that extends the length of the body, as shown for example in U.S. Pat. No. 3,785,763. This is illustrated in FIG. 30. Welding a stiffener on the outside surface of the combustion mixture plenum will generally result in thermal curling apparently because the stiffener tends to heat up excessively in such a location. This problem is not so pronounced where the burner body is 5 or more inches deep or is made of ⅛ inch thick stock of plain carbon steel.

Building a burner from sheet metal about 1/16 inch thick or slightly thinner, makes the construction less expensive than building it from thicker stock, and presents no significant problem when a burner is less than about four feet long. The depth of the combustion mixture plenum can be as little as desired, and a burner back only 1⅜ inches deep has proven entirely satisfactory for such short burners without presenting a rigidity problem. This combination of shallow depth and thin gauge is particularly desirable.

When using spaced matrix hold-down angles as at 521 in FIG. 14, it is preferred to make those angles from stock a little thicker than 1/16 inch, as noted in connection with that figure. The use of two bolts to clamp each angle to the back of the burner body also provides a little stiffening for the burner. However burners about four feet long or longer need more stiffening if they are operated in a position other than face up in a relatively cool location.

The stiffening of FIG. 30 is all that is needed for burners as long as 12 feet firing face down. Such burners with backs only 1⅜ inches deep need no more than three spaced supports and will not bow significantly as a result of the heat generated when operated at maximum output. Mounting the matrix and hold-down members over the 1⅜ inch deep burner back gives the burner an overall depth of about 2½ inches, and this is shown in applicant's parent application Ser. No. 178,121 filed Aug. 14, 1980. For extra insurance, however, it is preferred to make those thin sheet metal burner backs a little deeper—up to about 2½ inches, and that depth is particularly useful for burners as long as 20 feet operating face down, provided the stiffening of FIG. 30 is included. These burners have an overall depth of about 3⅝ inches.

Sheet steel is the preferred metal to use for constructing the burner, because of its low cost. Stainless steels are stronger, present a better appearance and do not need painting or other protection, so that they are more convenient to use. The saving of a little metal thickness as well as in construction costs, makes stainless steel particularly desirable as compared to cold rolled 1010 steel, even though stainless steels cost more per pound and are poorer conductors of heat.

Where maximum heat conductivity is needed, as in the burner of FIG. 18 for the purpose of conducting heat away from the cement holding the matrix edges, aluminum is preferred as a burner body metal whose walls are to be relatively thin—about ⅛ inch thick or thinner. Steels can be used for thicker—walled bodies of such burners. Burner walls of ⅛ inch thick soft aluminum are not significantly stiffer than 1/16 inch thick stainless steel walls.

The air-seal plenum walls and the associated matrix hold-down members, surrounding the burners of FIGS. 1, 10 and 13, for example, do contribute some stiffening to these burners, but by reason of their construction this stiffening is insignificant as compared to the stiffening of a full-length diffuser welded to the interior of the burner back along the entire length of the combustion mexture plenum. Such a diffuser need only be about ¾ inch to one inch deep, and the space between the inner face of the matrix and the outer face of the diffuser can be as little as ½ inch. Cold-rolled 1010 steel about 40 to 60 mils thick makes a very effective stiffening diffuser and needs no protection inasmuch as it is entirely inside the burner.

Where burners are made long and narrow, the diffuser is best dimensioned to have a width that occupies essentially the entire interior width of the combustion mixture plenum, as in FIG. 13, inasmuch as this provides the greatest stiffening effect. The diffuser need not be perforated if it is less than about seven feet long inasmuch as combustion mixture discharged from its open ends burns fairly uniformly along the entire matrix face. The use of spaced spot welds to weld the diffuser legs in place, as in FIG. 14, permits the resulting joint to pass gas to a small degree, but extra passageways are needed when the burner is longer than about 7 feet.

The extra stiffening and the extra resistance to thermal bowing, are provided by the diffuser whether or not the burner has an air-seal at its margin, and regardless of the metal from which the burner body is made. Stainless steel burner walls, by reason of their poor heat conductivity, will tend to be hotter than plain carbon steel walls, where they are subjected to high ambient temperatures, and are accordingly more in need of the extra resistance to thermal bowing.

The gas-fired burners of the present invention have a greater cost-effectiveness than electrically fired heaters and also provide a greater intensity of infra-red radiation. They are accordingly highly suited for use wherever electrically fired heaters have been used, as for example, to shrink-wrap articles with plastic as described in U.S. Pat. No. 4,228,345, or to heat-treat metal strips, sheets, and wire.

Obviously many modifications and variations of the present invention are possible in the light of the above teachings. It is therefore to be understood that within the scope of the appended claims the invention may be practiced otherwise than as specifically described.

What is claimed:

1. In a gas-fired infra-red-generating burner having a ceramic fiber matrix on a surface of which the burning of the gas takes place while the matrix is clamped in place by at least one metal hold-down flange pressed in squeezing engagement against the margins of that surface and having a width extending from the matrix edges to a location inboard of those edges, the improvement according to which about 1 to about 5 millimeters of the flange width at the inboard edge of said flange is curled away from the balance of the flange width to relieve the flange edge engagement with the matrix.

2. In a gas-fired infra-red-generating burner having a ceramic fiber matrix on a surface of which the burning of the gas takes place while the matrix is clamped against a narrow marginal shelf by at least one hold-down flange pressed against the margins of that matrix surface, the shelf having a width extending from the matrix edges to a location inboard of said edges, the improvement according to which about 1 to about 5 millimeters of the shelf width at its inboard edge is curled away from the balance of the shelf width to dig into the matrix.

3. In a gas-fired infra-red-generating burner having a ceramic fiber matrix on a surface of which the burning of the gas takes place while the matrix is clamped against a narrow marginal shelf by at least one metal hold-down flange pressed in squeezing engagement against the margins of that surface, both the flange and the shelf having widths extending from the matrix edges to locations inboard of these edges, the improvement according to which about 1 to about 5 millimeters of the shelf width at is inboard edge is curled away from the balance of the shelf width to dig into the matrix and about 1 to about 5 millimeters of the flange width at its inboard edge is curled away from the balance of the flange width to relieve the flange edge engagement with the matrix.

4. In an infra-red generating burner having a generally rectangular body with perpendicular side walls whose upstanding edges are bent toward each other to form ledges against which is supported the edges of a ceramic fiber panel, and at least one metal hold-down angle having a first flange engaging the outer surface of the panel margin to hold the panel margins against said ledges and having a second flange extending toward the nearby body side wall, the improvement according to which the second flange of each hold-down angle is in the same plane as said nearby body side wall.

5. The combination of claim 4 in which each second flange is too short to reach the nearby body side wall when the fiber panel is clamped against the ledges.

* * * * *